US012486087B2

(12) United States Patent
Wong

(10) Patent No.: US 12,486,087 B2
(45) Date of Patent: Dec. 2, 2025

(54) CLOSURE MEANS

(71) Applicant: Lok Hey Wong, Hong Kong (HK)

(72) Inventor: Lok Hey Wong, Hong Kong (HK)

( * ) Notice: Subject to any disclaimer, the term of this patent is extended or adjusted under 35 U.S.C. 154(b) by 0 days.

(21) Appl. No.: 18/619,733

(22) Filed: Mar. 28, 2024

(65) Prior Publication Data

US 2025/0229950 A1 Jul. 17, 2025

Related U.S. Application Data

(60) Provisional application No. 63/621,256, filed on Jan. 16, 2024.

(51) Int. Cl.

| | |
|---|---|
| ***B65D 51/16*** | (2006.01) |
| ***B65D 43/02*** | (2006.01) |
| ***B65D 43/26*** | (2006.01) |
| ***B65D 53/02*** | (2006.01) |

(52) U.S. Cl.

CPC ..... *B65D 51/1694* (2013.01); *B65D 43/0208* (2013.01); *B65D 43/267* (2013.01); *B65D 53/02* (2013.01); *B65D 2205/00* (2013.01)

(58) Field of Classification Search

CPC .. B65D 43/0208; B65D 43/267; B65D 53/02; B65D 45/16; B65D 45/06

See application file for complete search history.

(56) References Cited

U.S. PATENT DOCUMENTS

| | | | | |
|---|---|---|---|---|
| 2017/0247151 | A1* | 8/2017 | Chiou | B65D 43/163 |
| 2020/0189829 | A1* | 6/2020 | Han | B65D 25/06 |
| 2024/0101320 | A1* | 3/2024 | Lixin | B65D 43/267 |
| 2024/0150108 | A1* | 5/2024 | Lixin | B65D 43/0208 |
| 2025/0083874 | A1* | 3/2025 | Wong | B65D 53/02 |

* cited by examiner

*Primary Examiner* — Shawn M Braden
(74) *Attorney, Agent, or Firm* — WPAT, PC

(57) ABSTRACT

The present invention relates to a closure means for closing the opening of a container, said closure means comprising: a) a lid assembly, comprising: a lid cover, configured to provide an upper plate and a lower plate connecting said upper plate via standing wall therebetween, said upper plate is provided with at least one hinge member; at least one wing member comprising a handling portion, a flipping portion, and a stopper portion, said wing member pivotably connecting to said lid cover at said hinge member and thus movable between a first position where said stopper portion being away from said upper plate of said lid cover and a second position where said stopper portion being engaged with said upper plate of said lid cover and thus the upward movement of said wing member with respect to said lid cover being limited; and b) a sealing element, fittingly mounted around said standing wall of said lid cover; and characterized in that, in a first configuration where said container being closed with said closure means, said wing member being moved from said first position to said second position causing said closure means being moved upwards automatically.

13 Claims, 45 Drawing Sheets

CLOSURE MEANS

FIELD OF THE INVENTION

The present invention relates to a novel design of a closure means and a container. The present invention also relates to a novel method for channeling gas during sealing the container with the closure means and/or unsealing the container that is sealed with the closure means.

BACKGROUND OF THE INVENTION

In today's fast-paced world, the demand for innovative and efficient packaging solutions has never been higher. Consumers expect their food and beverage products to stay fresh, flavorful, and secure, even after repeated use. Many conventional container designs lack an efficient sealing mechanism. These sealings may not create a tight seal or fail to expel air effectively, leading to air pockets remaining within the container. This can result in reduced product freshness and quality. In certain cases, container designs may not prioritize the user experience during the closing process. The closure mechanisms might be difficult to operate or require excessive force, making it challenging for users to expel air effectively. This can lead to frustration and a suboptimal sealing outcome. Moreover, the conventional containers are designed to provide independent closure means and gas channeling means, it can introduce inconveniences for users. When these means are separate and require separate operations, it can lead to additional steps and complexities during the closing process, potentially resulting in user frustration.

The present invention seeks to address issues of these problems by offering an improved sealing mechanism and integrating closure and gas channeling means into a single operation, enhancing product freshness, quality, and user convenience. Alternatively, the present invention at least provides an alternative to the public.

SUMMARY OF INVENTION

The first aspect of the present invention relates to a closure means for closing the opening of a container, said closure means comprising: a) a lid assembly, comprising: a lid cover, configured to provide an upper plate and a lower plate connecting said upper plate via standing wall therebetween, said upper plate is provided with at least one hinge member; at least one wing member comprising a handling portion, a flipping portion, and a stopper portion, said wing member pivotably connecting to said lid cover at said hinge member and thus movable between a first position where said stopper portion being away from said upper plate of said lid cover and a second position where said stopper portion being engaged with said upper plate of said lid cover and thus the upward movement of said wing member with respect to said lid cover being limited; and b) a sealing element, fittingly mounted around said standing wall of said lid cover; and characterized in that, in a first configuration where said container being closed with said closure means, said wing member being moved from said first position to said second position causing said closure means being moved upwards automatically.

In some embodiments, in said second position, said stopper portion of said wing member engaging with said upper plate of said lid cover.

In some embodiments, in said second position, said stopper portion of said wing member engaging with said upper plate of said lid cover, wherein the angle between said flipping portion and said lid cover does not exceed 90 degrees.

In some embodiments, characterized in that, in a second configuration where said closure means being assembled to said container but yet unsealing said container, said wing member being moved from said second position to said first position causing said closure means being moved downwards automatically. Preferably, the transition from said second condition to said first condition can be operated by pushing said closure means downwards. Preferably, said sealing element is received in said container after said container is sealed with said closure means.

In some embodiments, when said lid cover is provided with two wing members, in said first configuration, said wing members being moved from said first position to said second position causing said closure means being moved vertically upwards automatically.

In some embodiments, characterized in that, said handling portion is provided with at least one locking member; and said container having surrounding wall having a first edge connecting to a bottom and a second edge defining an open-top for said container, wherein said second edge is configured to engage with said locking member.

Preferably, said locking member is selected from an inwardly protruded finger and/or an elevation for interacting with said second edge of said container.

In some embodiments, characterized in that, said lid cover is provided with a tooth member, such that the interaction between said tooth member and said flipping portion of said wing member provides a locking effect.

Preferably, in said first configuration, said tooth member at least being covered by said flipping portion; and in said second configuration, the interaction between said tooth member and said flipping portion being free.

In some embodiments, said container having surrounding wall having a first edge connecting to a bottom and a second edge defining an open-top for said container, characterized in that, in said first configuration, the engagement between said flipping portion of said wing member and said second edge of said container being surface contact. Preferably, in said second configuration, the engagement between said flipping portion of said wing member and said second edge of said container being line contact or point contact.

The second aspect of the present invention relates to the novel design of the closure means described in the first aspect.

The present invention has further aspects that relates to a lid assembly, a lid cover, a wing member, a gas channeling means, a sealing element used in the closure means of the first and/or second aspect(s). The design of these elements serves a crucial purpose: to efficiently remove air from the container prior to sealing. This design ensures that as the lid assembly closes the container, any excess air is effectively evacuated. By eliminating the air from the container, the sealing element helps create an airtight environment inside, which is particularly beneficial for preserving the freshness and quality of the container's contents. This innovative sealing element design enhances the sealing process, contributing to the overall effectiveness of sealing. In addition to the sealing element and gas channeling means, the design of the wing member plays a vital role in ensuring the lid assembly remains securely attached to the container after closure. The primary objective of this design enhancement is to prevent any accidental disengagement or detachment of the lid assembly from the container. The novel design of the lid cover plays a vital role in allowing when closing the lid assembly onto the container, air will be eliminated from the container through a gas channeling means provided in the lid cover. When opening the lid assembly from the container, air will enter the container through the gas channeling means. The novel design of the wing member plays a vital role in allowing when closing the lid assembly onto the container, air will be eliminated from the container through a gas channeling means provided in the wing member. When opening the lid assembly from the container, air will enter the container through the gas channeling means. The novel design of the sealing element, the lid cover, and the wing member can be practiced independently or in any combination thereof.

DESCRIPTION OF THE DRAWINGS

Some embodiments of the present invention will now be explained, with reference to the accompanied drawings, in which:—

FIGS. 8D-1-8D-6 are schematic drawings showing the operation of the second type of wing member with different containers;

FIGS. 8E-1-8E-6 are schematic drawings showing the operation of the third type of wing member with different containers;

FIGS. 8F-1-8F-6 are schematic drawings showing the operation of the fourth type of wing member with different containers;

FIGS. 8G-1-8G-6 are schematic drawings showing the operation of the fifth type of wing member with different containers;

DETAILED DESCRIPTION OF PREFERRED EMBODIMENTS OF THE INVENTION

Figure 1:
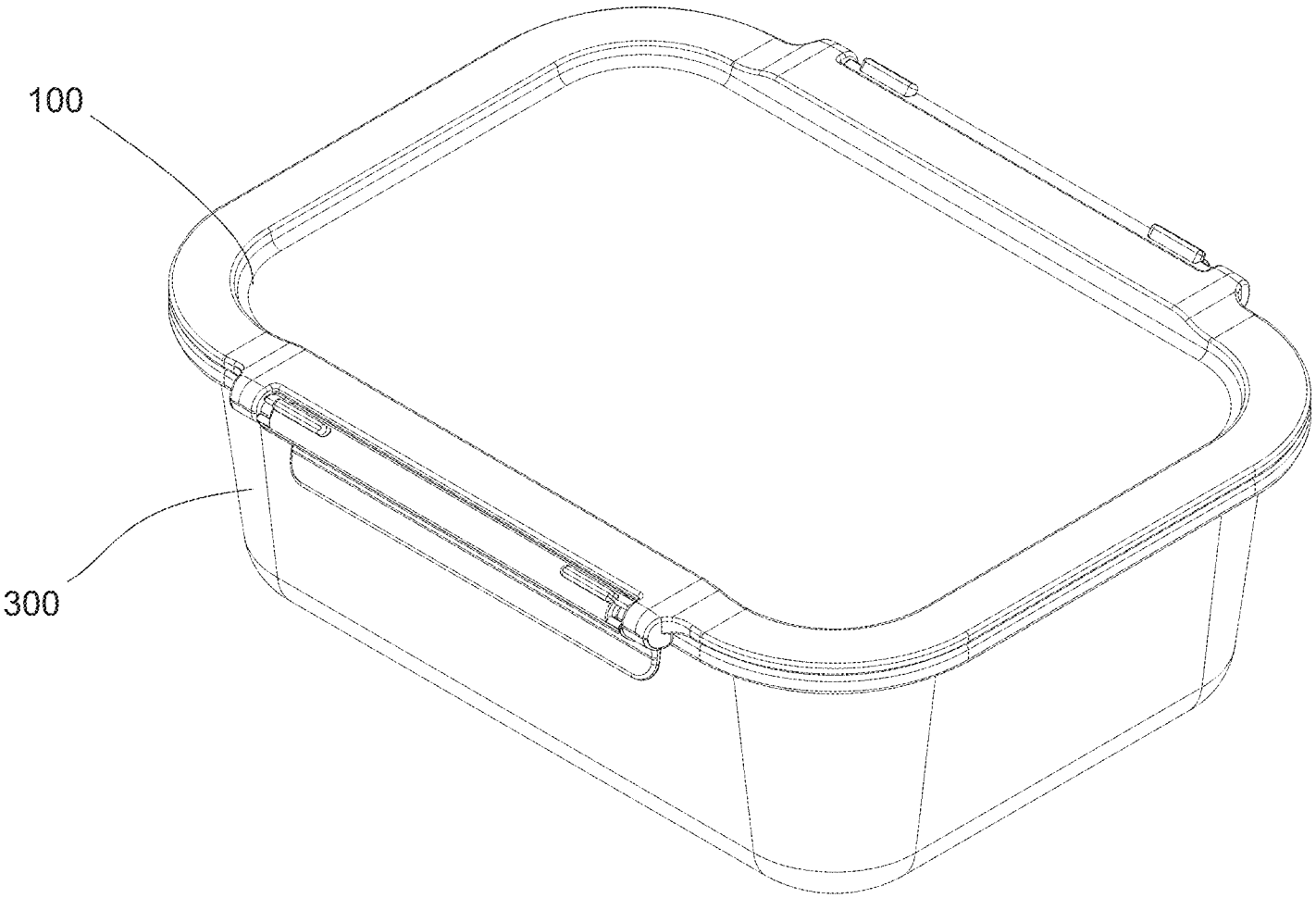
FIG. 1 is a perspective view showing a first embodiment of a closure means sealed to a container.

The present invention is now presented by way of examples with reference to the figures in the following paragraphs. Objects, features, and aspects of the present disclosure are disclosed in or are apparent from the following description. It shall be understood by one of ordinary skilled in the art that the following description is a description of exemplary embodiments only, and is not intended as limiting the broader aspects of the present disclosure, which broader aspects are embodied in the exemplary constructions.

It should be noted that, unless otherwise defined, the technical terms or scientific terms used in the embodiments of the present invention shall have the usual meanings understood by person with ordinary skills in the art to which the present invention belongs. "First", "second" and similar expression used in the embodiments of the present invention do not indicate any order, quantity or importance, but are only used to distinguish different components. "Front", "rear", "left", "right", "upper", and "lower" and other terms indicating orientation or similar terms are only described for the exemplary relative positional relationship shown in the drawings to facilitate the understanding. It does not limit the disclosed components in the present invention can only follow this specific relative positional relationship. "Connect or the like", "mount or the like" or "secure or the like" or "assemble or the like" is not limited to physical or mechanical connections, whether direct or indirect.

Figure 2:
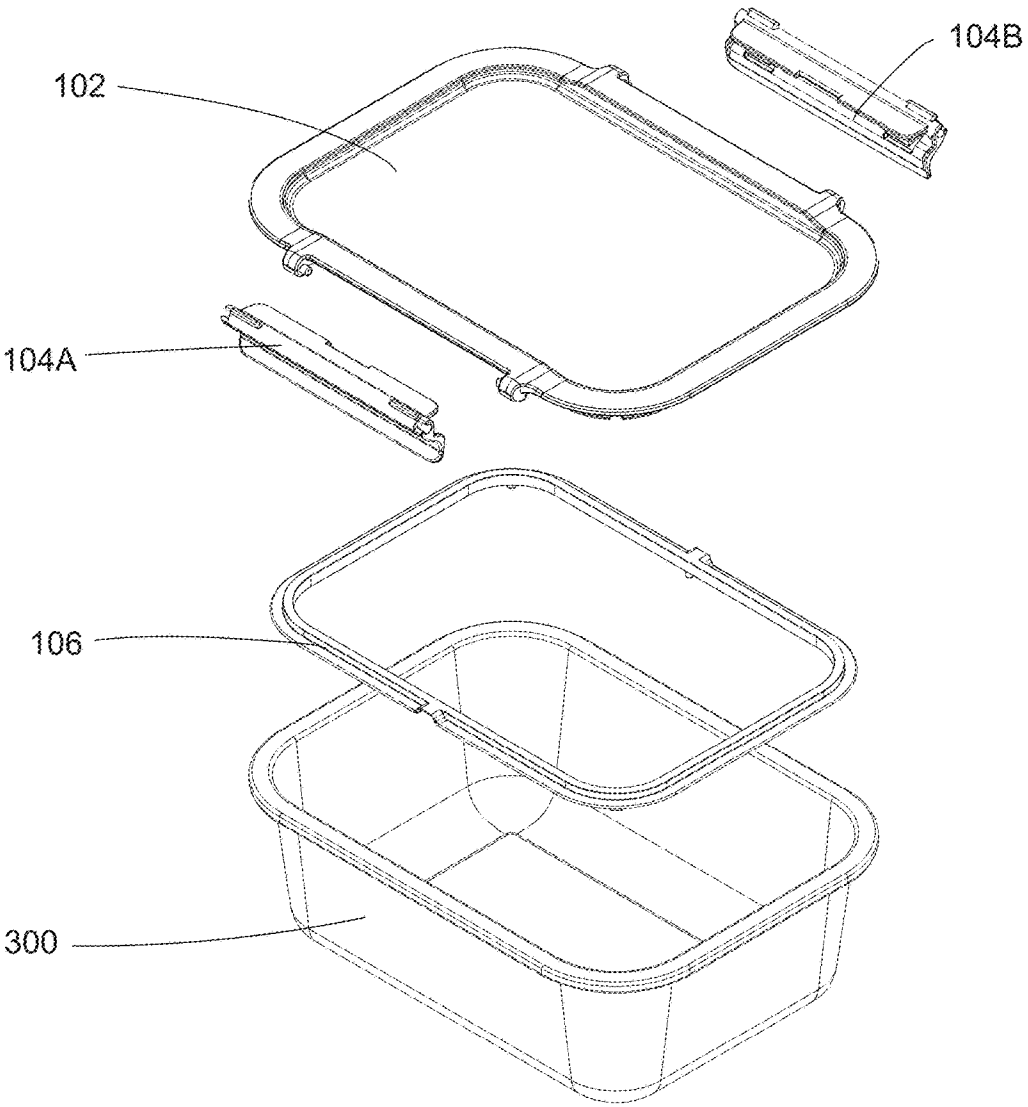
FIG. 2 is an exploded view of the illustration in FIG. 1.

FIG. 1 shows a sealed container having a first embodiment of a closure means 100 sealed to a first embodiment of a container 300. FIG. 2 shows that the closure means 100 comprises a first embodiment of a lid assembly having a lid cover 102, a pair of wing members 104A and 104B; the lid assembly is coupled with a sealing element 106. In other words, the assembly between the lid cover 102 and the pair of wing members 104A and 104B define the first embodiment of the lid assembly. It shall be noted that the closure means of the present invention can work with only one wing member, three wing members or four wing members.

Figure 3A:
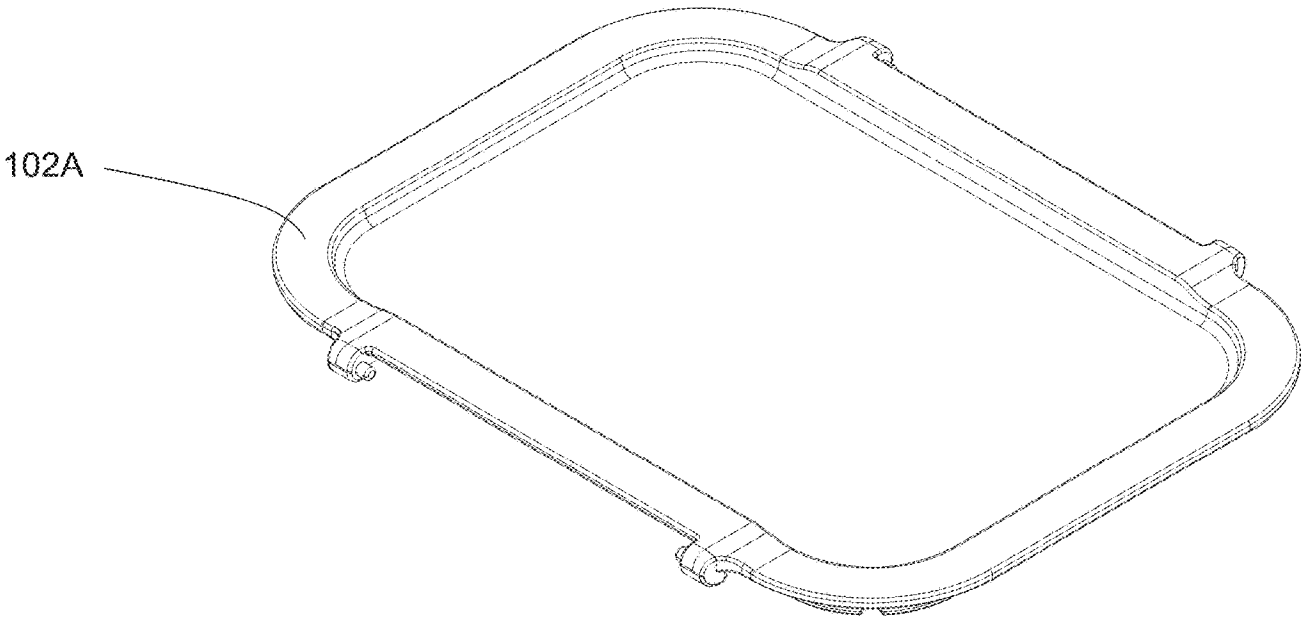
FIGS. 3A-E show a lid cover with different views.
Figure 3B:
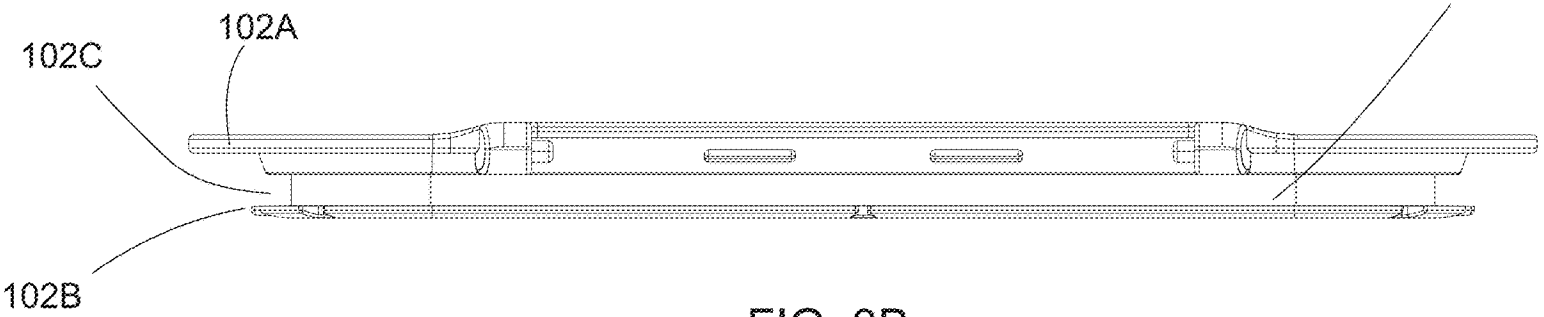
Figure 3D:
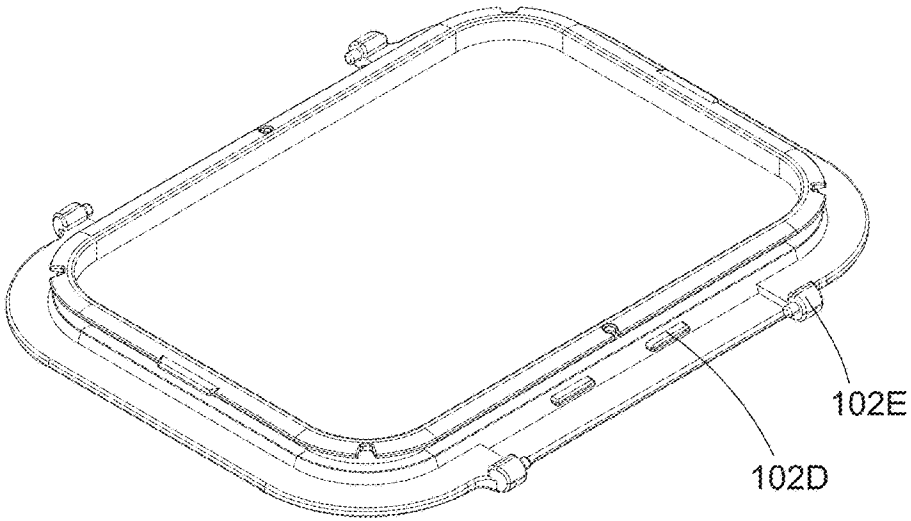
Figure 3C:
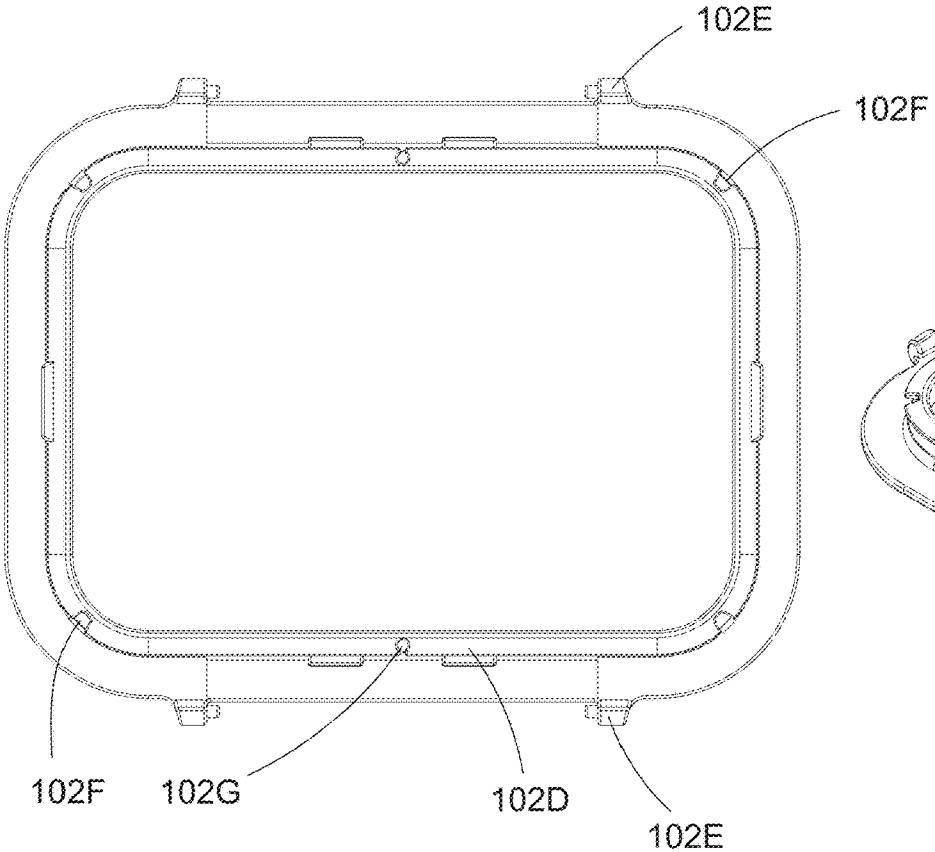
Figure 3E:
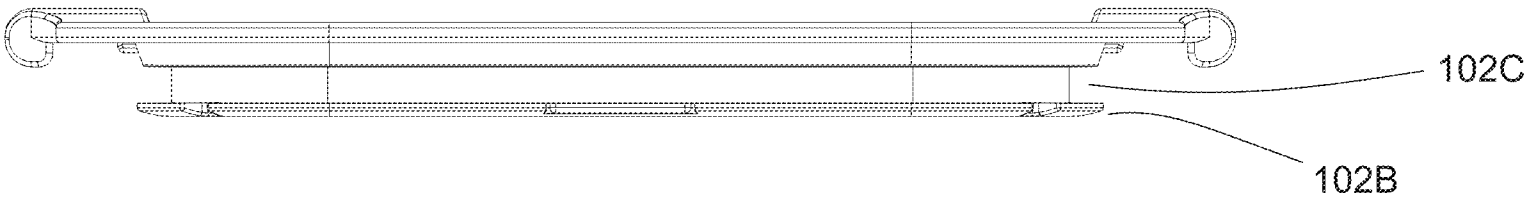

FIGS. 3A-3E show the lid cover 102 with different perspective views, in which FIG. 3A is the elevation perspective view, FIG. 3B is a first side view, FIG. 3C is the bottom view, FIG. 3D is the bottom perspective view, and FIG. 3E is the second side view. As shown in FIGS. 3A and 3B, the lid cover 102 is configured to provide an upper plate 102A and a lower plate 102B connecting said upper plate 102A via standing walls 102AB. In some embodiments, the size of the lower plate 102B is smaller than that of the upper plate 102A and the lower plate 102B extends beyond the standing walls AB, such that a groove 102C is formed between the upper plate 102A and the lower plate 102B. Preferably, the closure means of the present invention is suitable for containers working with seal that is received inside the container during sealed. FIG. 3C shows that the lid cover 102 is provided with a plurality of tooth members 102D in a region around the perimeter of the lid cover 102, and is also provided with a plurality of hinge members 102E. Advantageously, the hinge members 102E are disposed adjacent the tooth members 102D. More advantageously, the tooth members 102D are positioned between the hinge members 102E, as shown in FIG. 3C. The lid cover 102 is further provided with a plurality of nodes 102F around the perimeter of the lower plate 102B.

Figure 4:
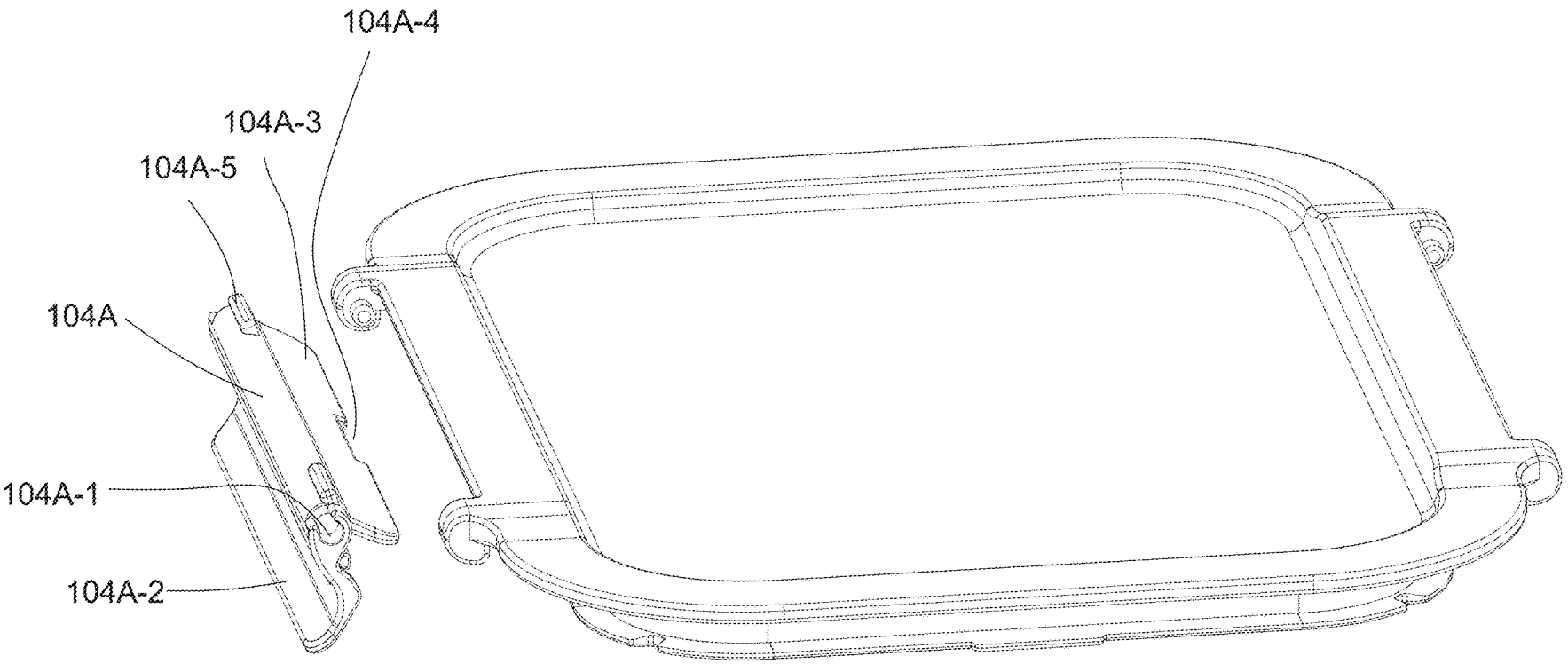
FIG. 4 is an exploded view of a first embodiment of the closure means.

FIG. 4 shows an exploded view of the assembly between a first wing member 104A and the lid cover 102. The first wing member 104A comprises a notch 104A-1 at the edge of the wing member 104A, a handling portion 104A-2, a flipping portion 104A-3 having a cut-out 104A-4, a stopper portion 104A-5. The notch 104A-1 engages with the hinge member 102E of the lid cover 102, allowing the wing member 104A to move pivotably about the hinge member 102E. It shall be understood that the wing member 104A is able to flip upwards or downwards because of the engagement between the notch 104A-1 and the hinge member 102E.

Figure 5B:
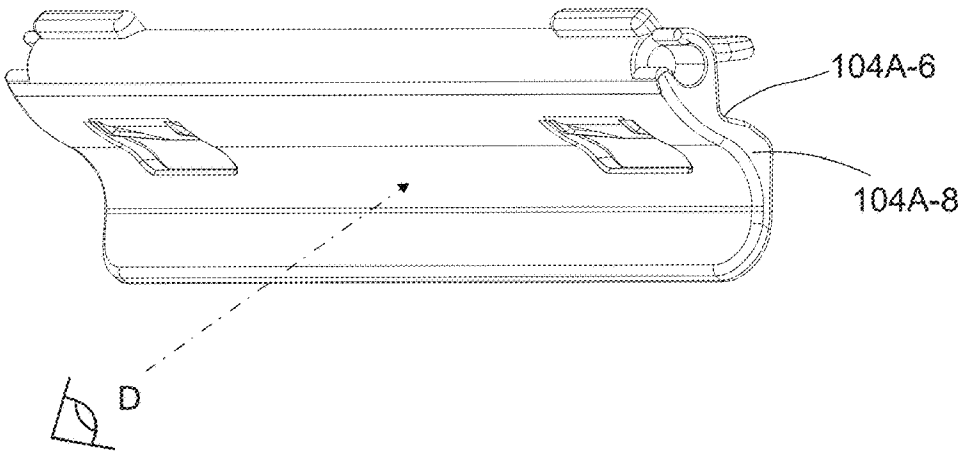
FIGS. 5A-E show a wing member with different views.
Figure 5A:
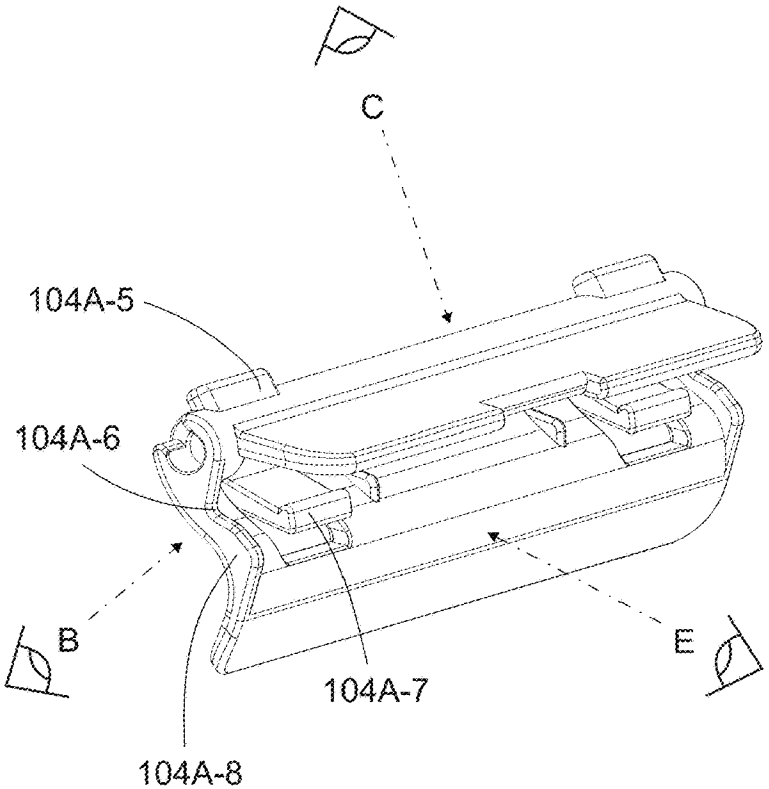
Figure 5C:
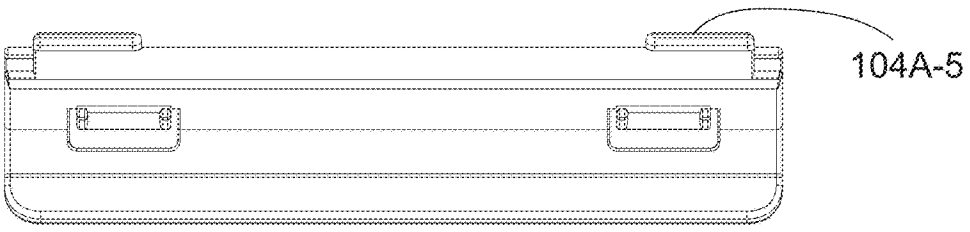
Figure 5D:
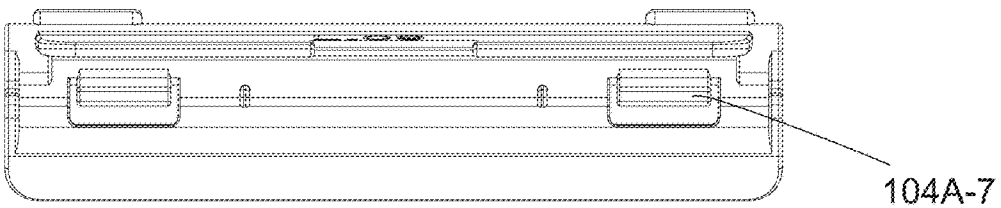
Figure 5E:
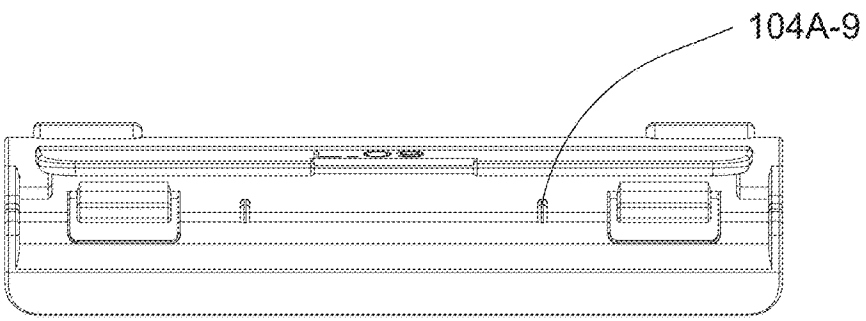
Figure 8A:
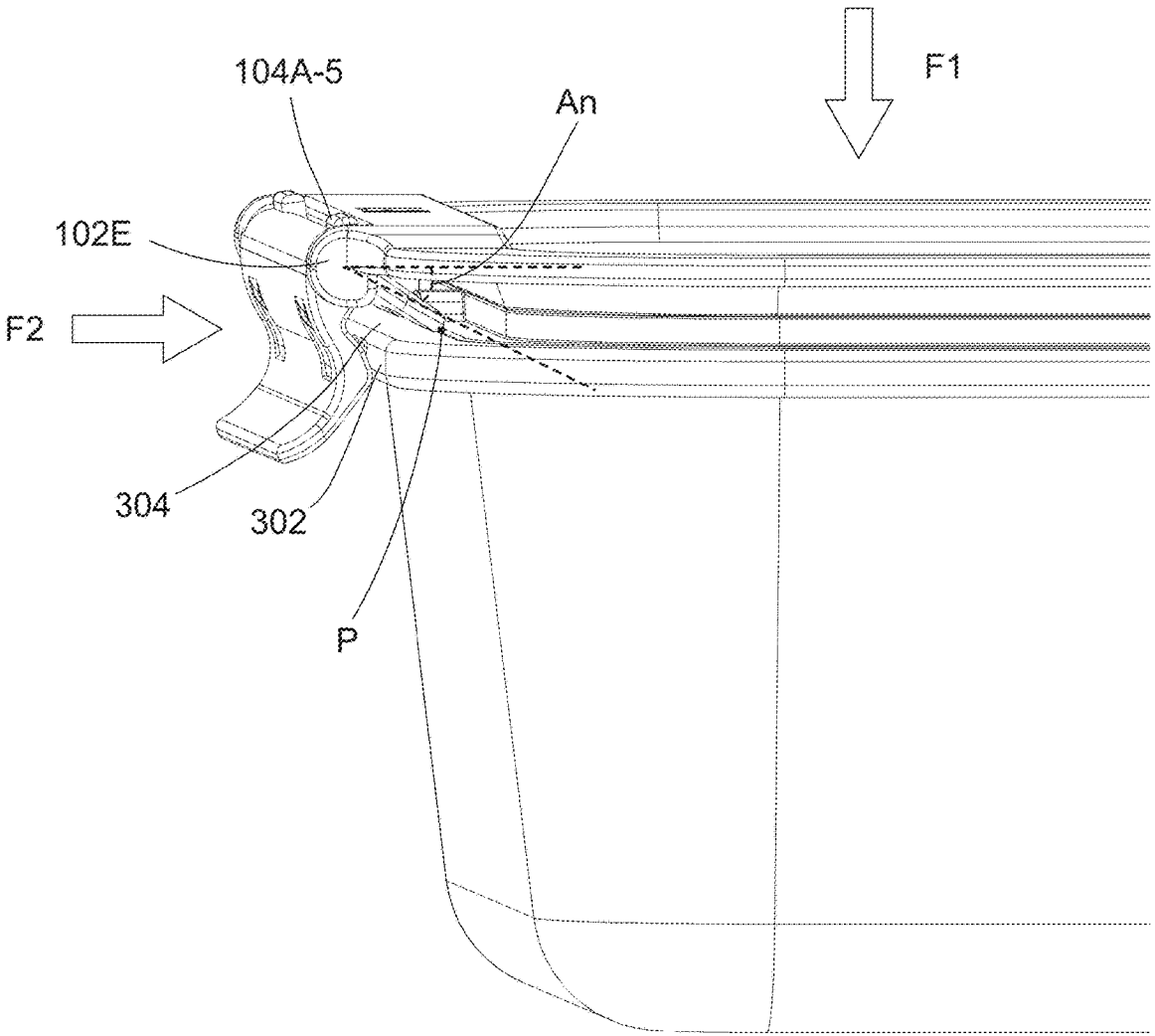
FIG. 8A is a schematic drawing showing how the closure means will be sealed to the container.
Figure 8B:
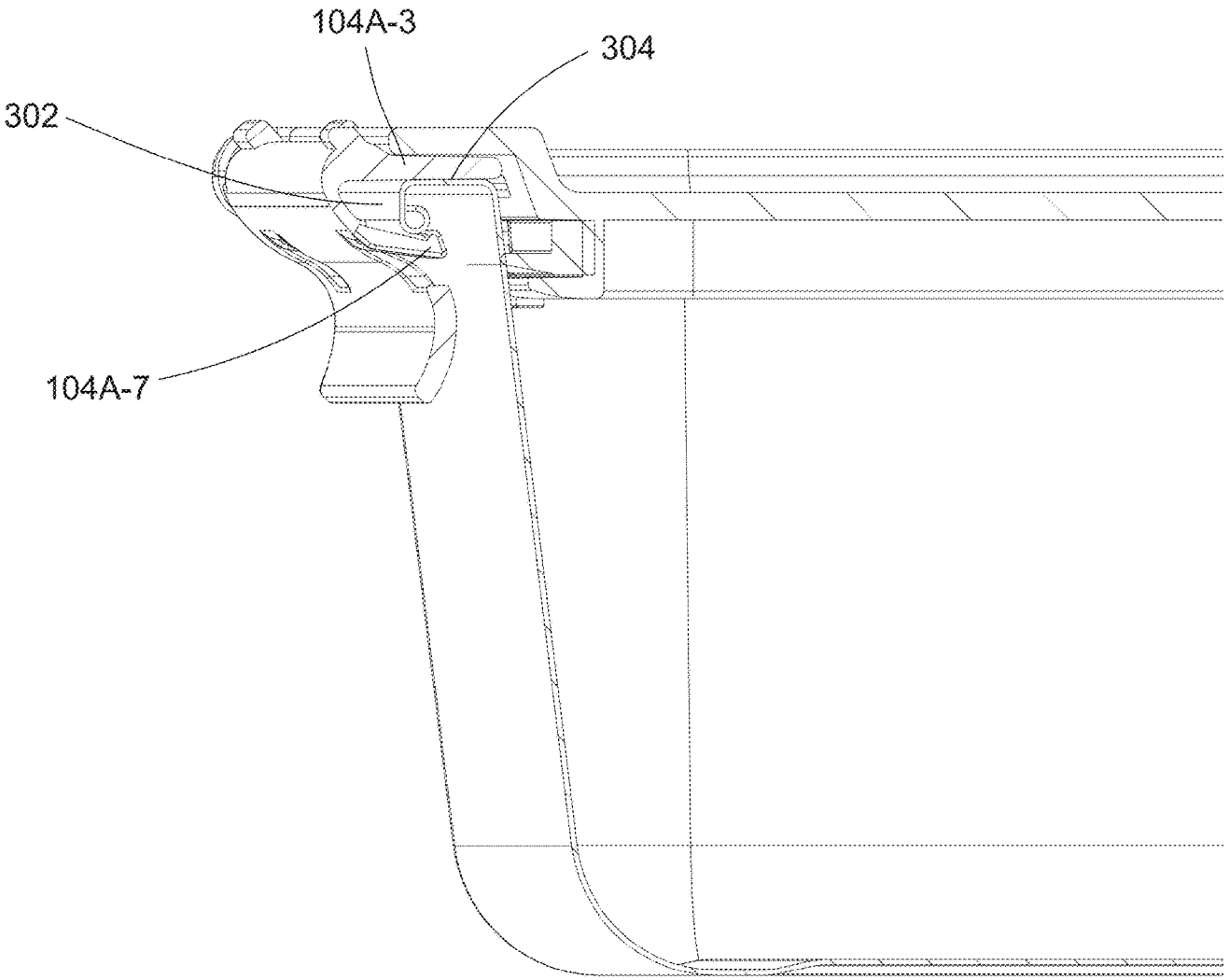
FIG. 8B shows that the closure means is in a sealed condition.
Figure 8C:
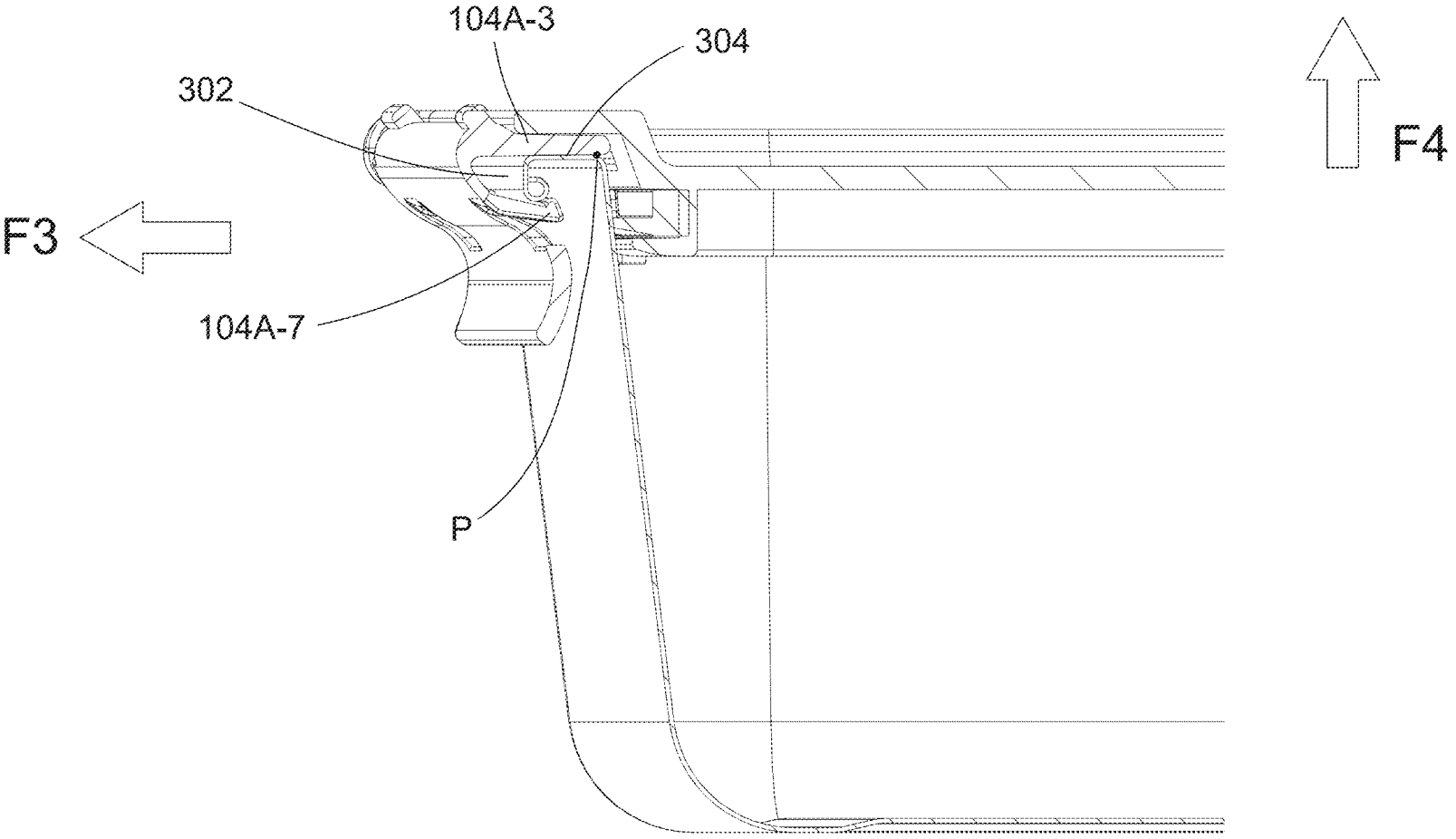
FIG. 8C is a schematic drawing showing how the closure means will be opened.
Figures 3, 8D:
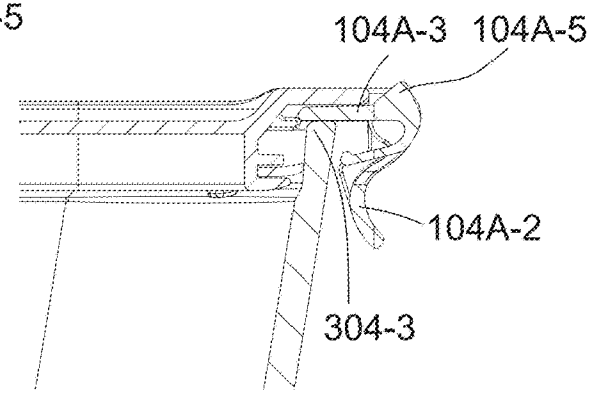
Figures 2, 8D:
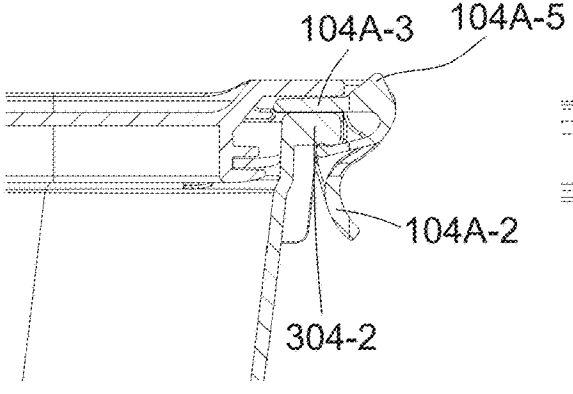
Figures 1, 8D:
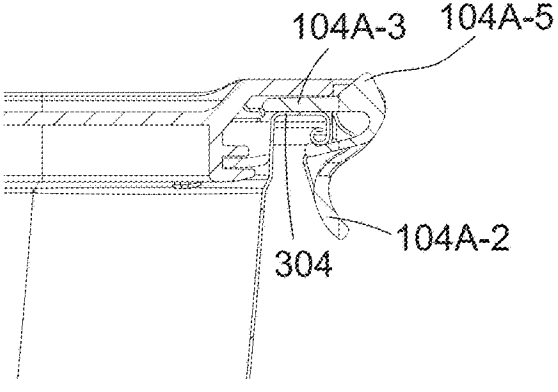
Figures 6, 8D:
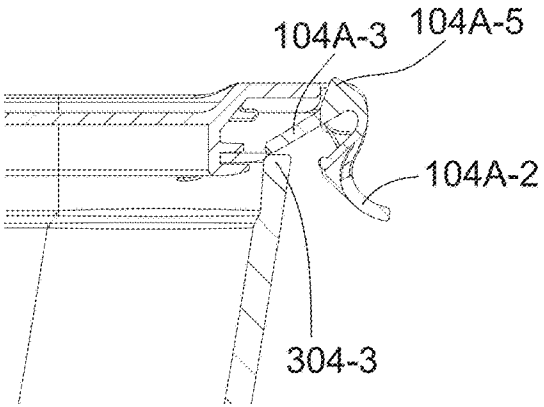
Figures 5, 8D:
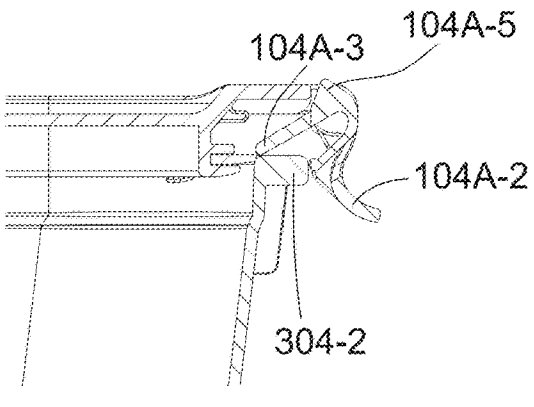
Figures 4, 8D:
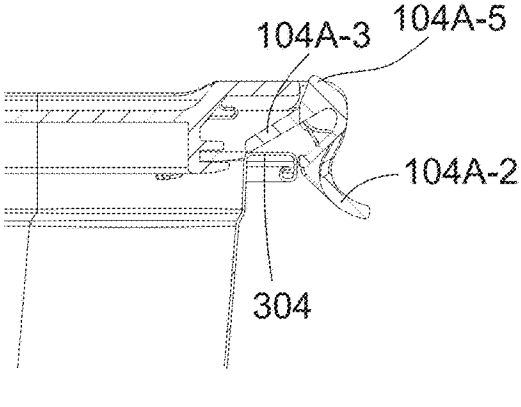

FIG. 5 shows the wing member 104A with different perspective view, in which FIG. 5A is a first perspective view, FIG. 5B is a second perspective view viewing from direction B indicated in FIG. 5A, FIG. 5C is a top view viewing from direction C indicated in FIG. 5A, FIG. 5D is a front view viewing from direction D indicated in FIG. 5B, and FIG. 5E is a side view viewing from direction E indicated in FIG. 5A. As shown in FIGS. 4 and 5A-5E, the handling portion 104A-2 is designed in a S-shape so as to provide a depression 104A-6 and an elevation 104A-8 each facing towards the wall of the container 300. Further, the handling portion 104A-2 is designed to provide a pair of inwardly fingers 104A-7 facing towards the wall of the container 300 as well. FIG. 5E illustrates that the inner side of the handling portion 104A-2 is provided with a pair of tabs 104A-9, which is adjacent the fingers 104A-7.

Figure 6B:
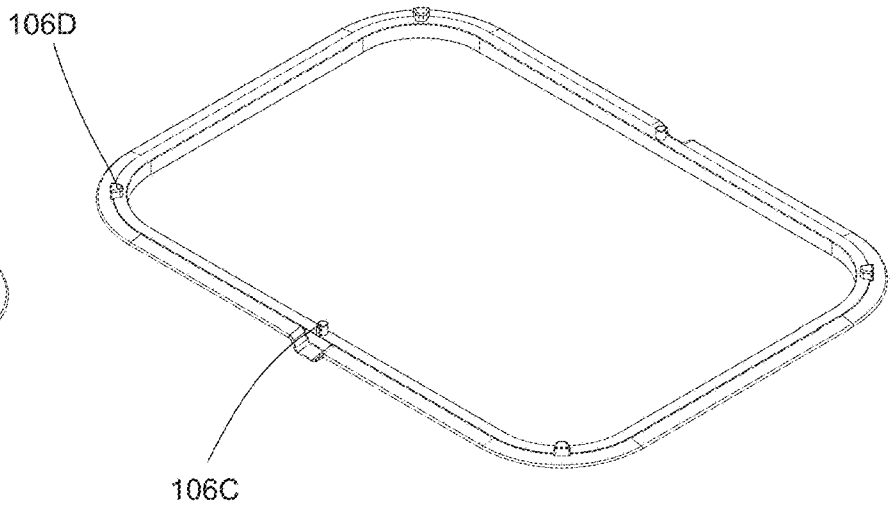
FIGS. 6A-D show a sealing element with different views.
Figure 6A:
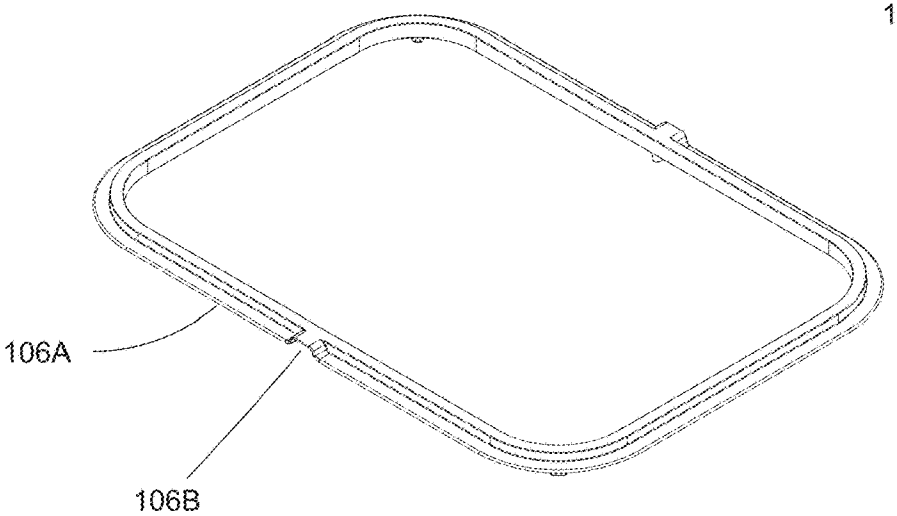
Figure 6C:
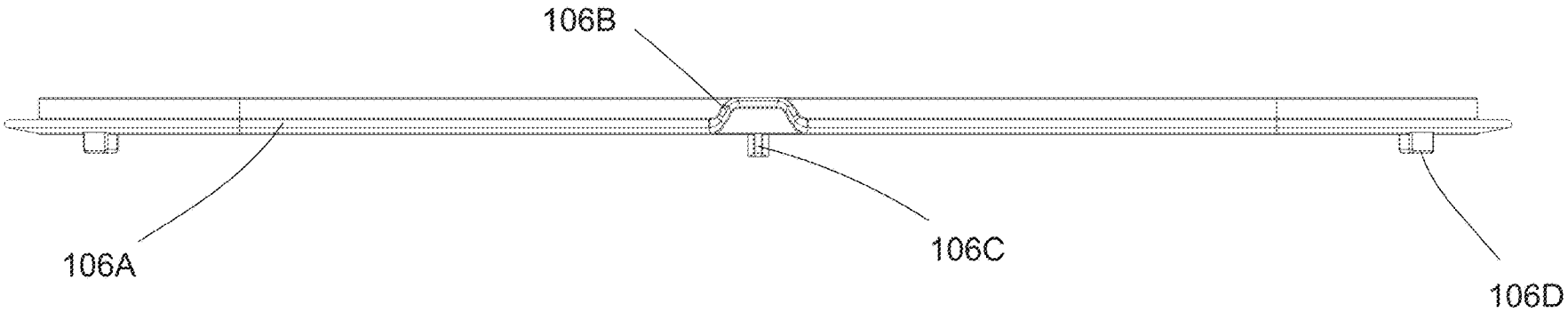
Figure 6D:
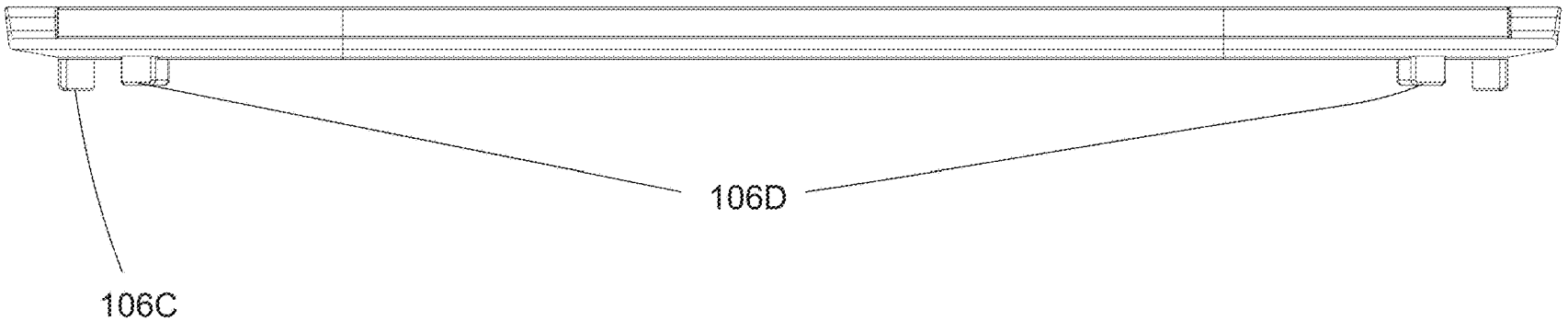

FIG. 6A-D shows the sealing element 106 in different perspective views, in which FIG. 6A is the elevation perspective view, FIG. 6B is the bottom perspective view, FIGS. 6C and 6D are side views. FIG. 6A show the circumference of the sealing element 106 is provided with a skirt 106A outwardly exposed. Preferably, the skirt 106A is at the lower edge of the sealing element 106. The sealing element 106 in these figures is in a rectangular shape, the skirt 106A at the length of the rectangular shape is profiled as a crest 106B, extending from the lower edge to the upper edge of the sealing element 106, as illustrated in FIG. 6C. The upper edge of the sealing element 106 is closer to the lid cover 102 in the lid assembly, while the lower edge of the sealing element 106 is close to the container 300 when the lid assembly is assembled to the container 300. FIG. 6B illustrates that the lower edge of the sealing element 106 is provided with a plurality of studs extending downwards therefrom. Two studs 106C are positioned close to the crest 106B, and four studs 106D are positioned at every corner of the rectangular shape of the scaling element 106. Preferably, as shown in FIG. 6D, stud 106C is longer than the stud 106D.

Figure 7B:
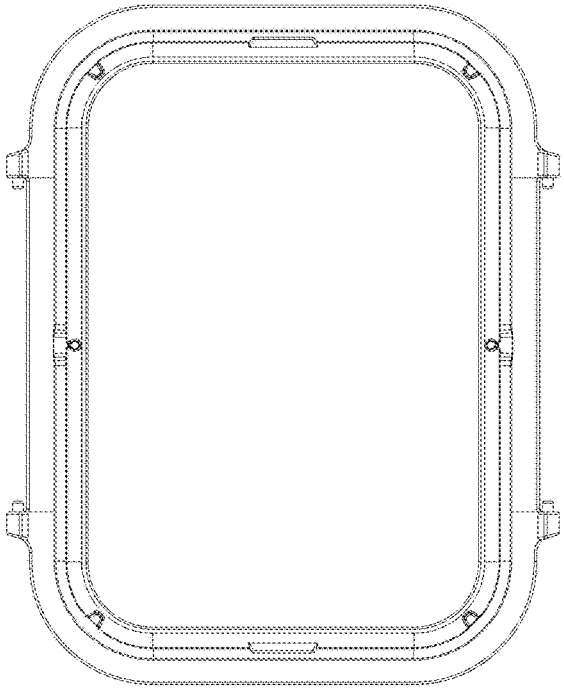
FIGS. 7A-C show the assembling of a sealing element to a lid cover with different views.
Figure 7A:
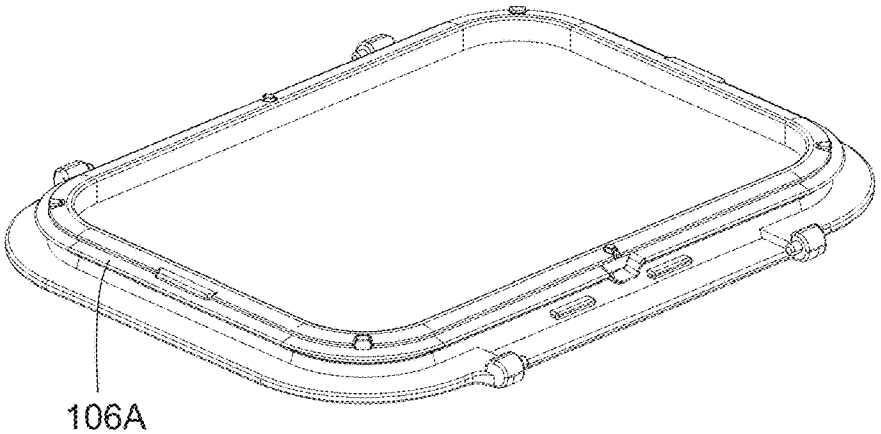
Figure 7C:
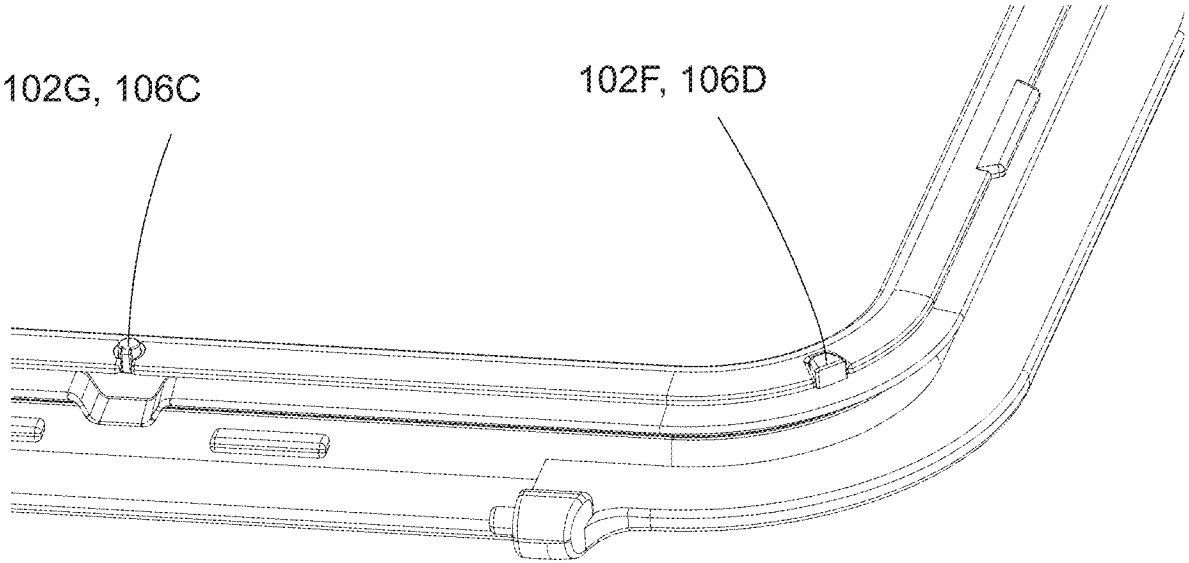

FIGS. 7A-C illustrates the assembling of the scaling element 106 to the lid cover 102 by fitting the scaling element 106 around the groove 102C of the lid cover 102. The studs 106C and 106D of the sealing element 106 are sized and shaped fit to the nodes 102G and 102F of the lid cover 102, respectively.

FIG. 8A shows that the closure means 100 is about to assemble to the container 300. At the state disclosed in FIG. 8A, the wing member 104A is not allowed to move pivotably upwards further about the hinge member 102E, since the long edge of the upper plate 102A of the lid cover 102 hinders the upwards pivotal movement of the stopper portion 104A-5 of the wing member 104A. When the closure means 100 in FIG. 8A is pressed further downwards with force in direction F1, the closure means 100 will then be secured to the container 300 as illustrate in FIG. 8B. Advantageously, the design of the depression 104A-6 and the elevation 104A-8 of the wing member 104A assists in transmitting the downward force (denoted with the arrow F1 in FIG. 8A), exerted by a user, to a horizontal force (denoted with the arrow F2 in FIG. 8A) acting on the wing member 104A. In terms of operation, the user can exert pushing force F2 on wing member 104A, then due to the design of the wing member, the closure means 100 can be consequently sank/pushed downwards automatically with the downward force F1. The design of the depression 104A-6 and the elevation 104A-8 of the wing member 104A assists in transmitting the horizontal force F2 to a downward force F1, or vice versa. It shall be understood that the operation of the wing member of the present invention provides a levering effect to operably open and close the closure means of the present invention. Advantageously, the angle (denoted with "An" in FIG. 8A) between the flipping portion 104A-3 and the lid cover 102 does not exceed 90 degrees.

In FIG. 8B, finger 104A-7 engages with the collar 302 of the container 300, while the flipping portion 104A-3 is rest on the edge 304 of the container 300. It can be seen that the flipping portion 104A-3 and the edge 304 of the container 300 is surface contact in FIG. 8B, whereas the flipping portion 104A-3 and the edge 304 of the container 300 is line contact or point contact in FIG. 8A. It should be understood that the interaction between the collar 302 and the finger 104A-7 defines a lock mechanism to prevent the closure means 100 disengages with the container 300 after the closure means 100 closes the container 300. It should be understood that the interaction between the collar 302 and the elevation 104A-8 defines another lock mechanism to prevent the closure means 100 disengages with the container 300 after the closure means 100 closes the container 300. It should be noted that the design of the wing member 104A is an example to illustrate the lock mechanism(s) and shall not be construed as a limitation as the only means to operate the crest 106B of the sealing element 106 and shall not be construed as a limitation as the only means to operate the closure means of the present invention. Advantageously, experiments show that the closure means made of plastic works well with the sealing element 106. The interaction suitable for the lock mechanism can be snapping, interlocking, magnetic interaction between components.

FIG. 8C shows how the closure means 100 is opened. As indicated in FIG. 8C, an outward pulling force F3 is applied. By doing so, the interaction between the collar 302 and the elevation 104A-8 and the interaction between the collar 302 and the finger 104A-7 will be consequently disengaged. Under the pulling force F3, the wing member 104A pivotably moves upwards about the lid cover, thus the flipping portion 104A-3 acts against the edge 304 of the container 300, whereby providing a levering effect in that the flipping portion 104A-3 as the beam, point "P" in FIGS. 8A and 8C as the hinge or fulcrum, F3 as the effort, the lid cover as the load. With pulling force F3, the closure means in FIG. 8C will automatically move upwards with the uplifting force F4 due to the levering effect. With the explanation provided above, it should be understood that when a user opens the closure means of the present invention on the sealed container, the container's bottom can remain on a table. There is no need for the user to tilt the sealed container at an angle to facilitate ease of opening the closure means. In an embodiment where the closure means comprises two wing members, the closure means can be operated to move vertically upwards and downwards automatically with respect to the open-top of the container during unsealing and sealing, respectively.

Figures 1, 8E:
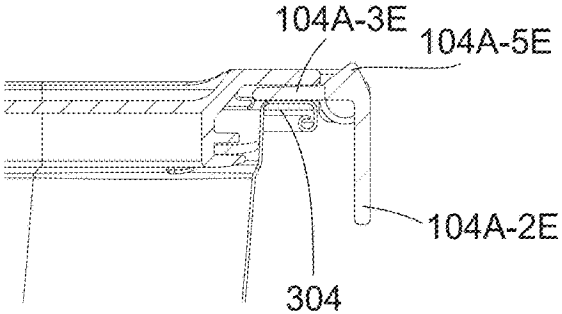
Figures 2, 8E:
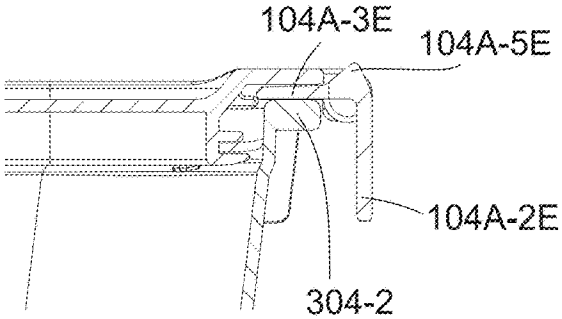
Figures 3, 8E:
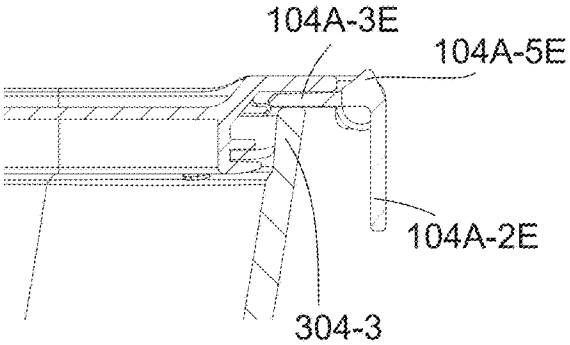
Figures 4, 8E:
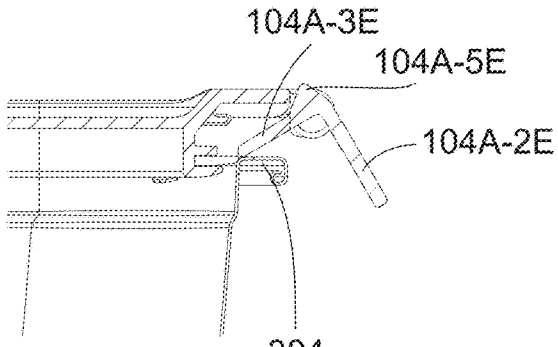
Figures 5, 8E:
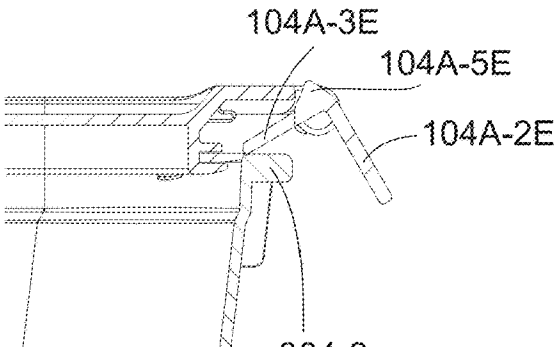
Figures 6, 8E:
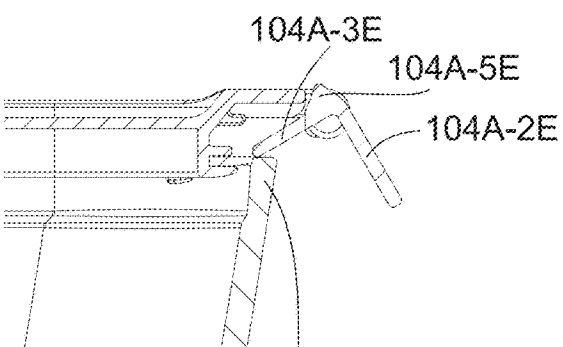
Figures 1, 8F:
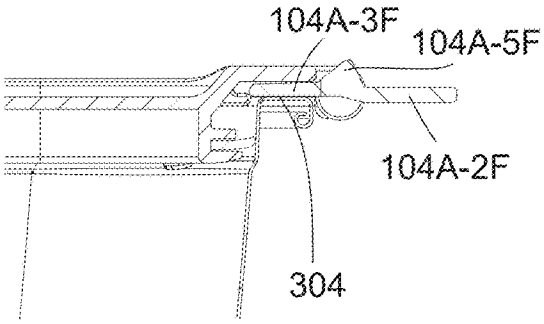
Figures 2, 8F:
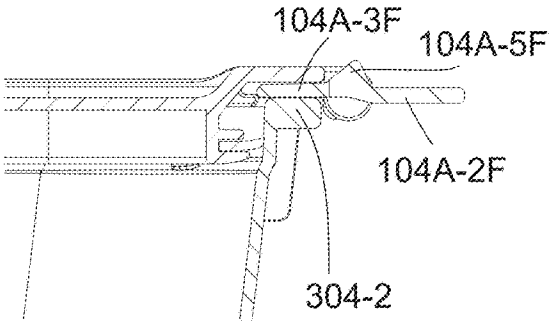
Figures 3, 8F:
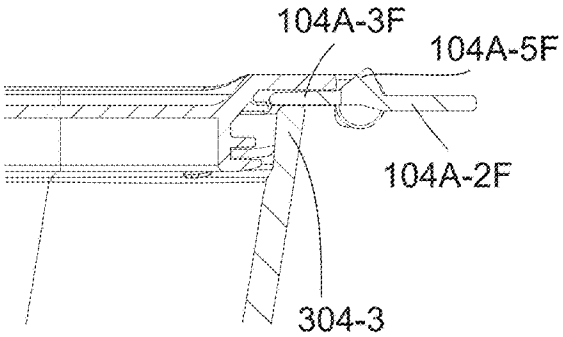
Figures 4, 8F:
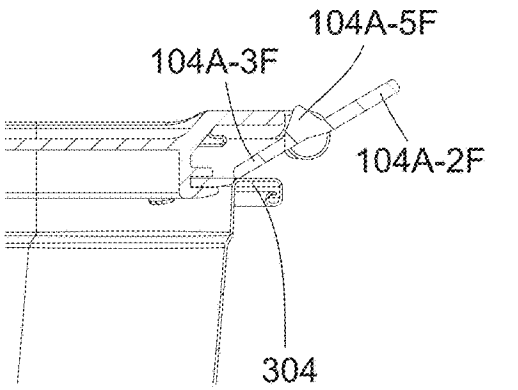
Figures 5, 8F:
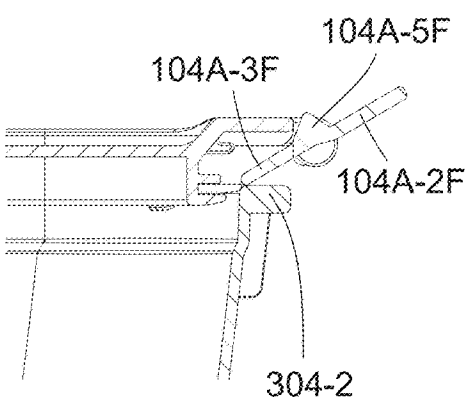
Figures 6, 8F:
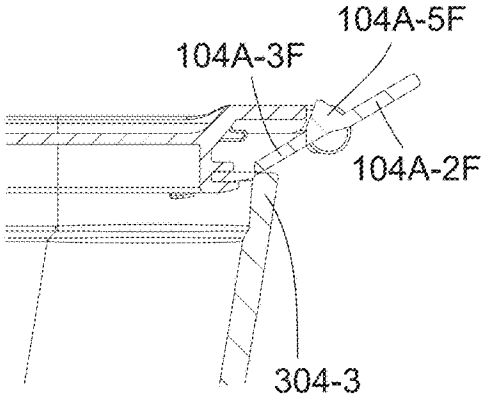
Figures 1, 8G:
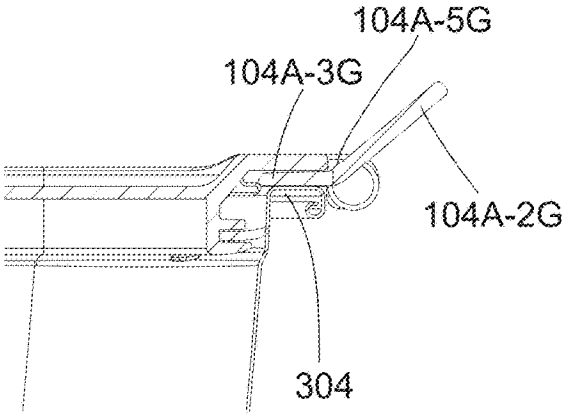
Figures 2, 8G:
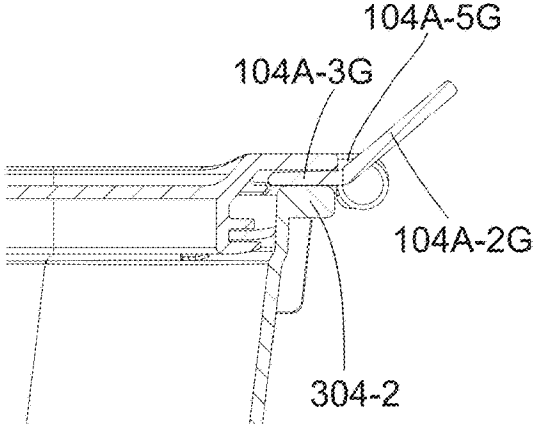
Figures 3, 8G:
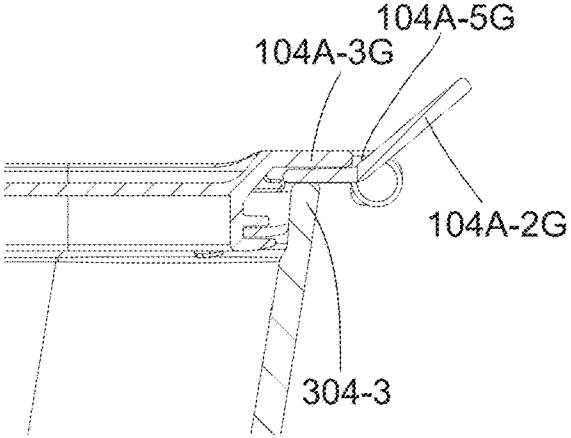
Figures 4, 8G:
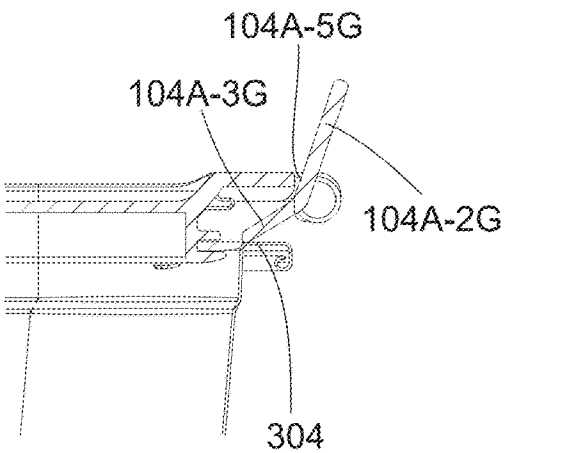
Figures 5, 8G:
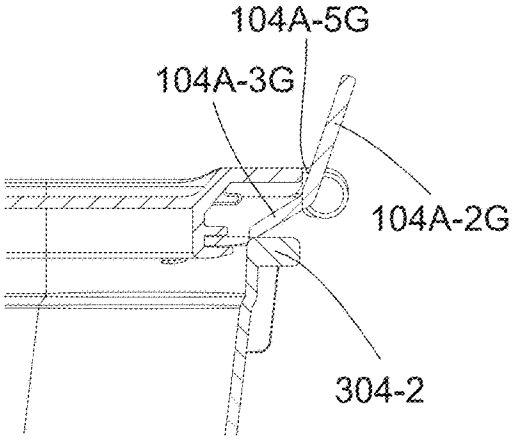
Figures 6, 8G:
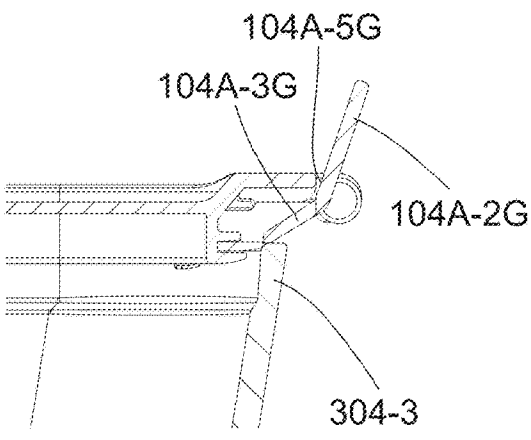

With regard to the "levering effect", it is realized by the lever system defining by the collaboration between the handling portion 104A-2, the flipping portion 104A-3, the edge 304 of the container 300, and the pivotable movement between the wing member 104A and the lid cover in particular the hinge member 102E. It shall be understood that the lever system of the present invention is not only realized by the embodiments in FIGS. 1-8C only. FIGS. 8D-1-8D-6 are schematic drawings showing the operation of the second type of wing member with different containers, in which FIGS. 8D-1-8D-3 show that the closure means is sealed to the container and FIGS. 8D-4-8D-6 show that the closure means is opened; FIGS. 8E-1-8E-6 are schematic drawings showing the operation of the third type of wing member with different containers, in which FIGS. 8E-1-8E-3 show that the closure means is sealed to the container and FIGS. 8E-4-8E-6 show that the closure means is opened; FIGS. 8F-1-8F-6 are schematic drawings showing the operation of the fourth type of wing member with different containers, in which FIGS. 8F-1-8F-3 show that the closure means is sealed to the container and FIGS. 8F-4-8F-6 show that the closure means is opened; and FIGS. 8G-1-8G-6 are schematic drawings showing the operation of the fifth type of wing member with different containers, in which FIGS. 8G-I-8G-3 show that the closure means is sealed to the container and FIGS. 8G-4-8G-6 show that the closure means is opened. These figures show that the lever system of the present invention works for different types of containers having its second edge that is configured into different shapes. In particular, the second edge of the container in FIG. 8D-1, FIG. 8E-1, FIG. 8F-1, and FIG. 8G-I is outwardly rolled to provide a surface 304 and then the edge further rolled to form a collar 302; the second edge of the container in FIG. 8D-2, FIG. 8E-2, FIG. 8F-2, and FIG. 8G-2 is configured to outwardly rolled to provide a surface 304-2; the second edge of the container in FIG. 8D-3, FIG. 8E-3, FIG. 8F-3, and FIG. 8G-3 is configured as a free edge 304-3. It should be noted that whether the wing member is provided with the lock mechanism(s), the lever system as described above still works.

Figure 9A:
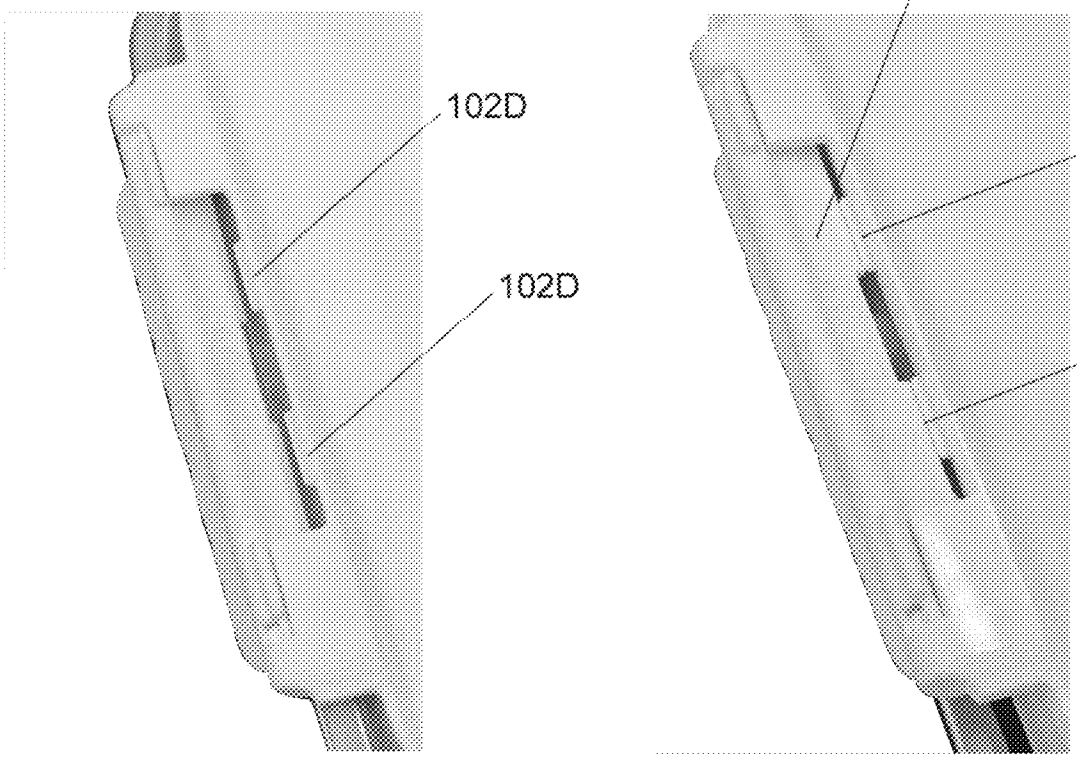
FIGS. 9A-9C show the locking condition of the prototype of a first embodiment.
Figure 9B:
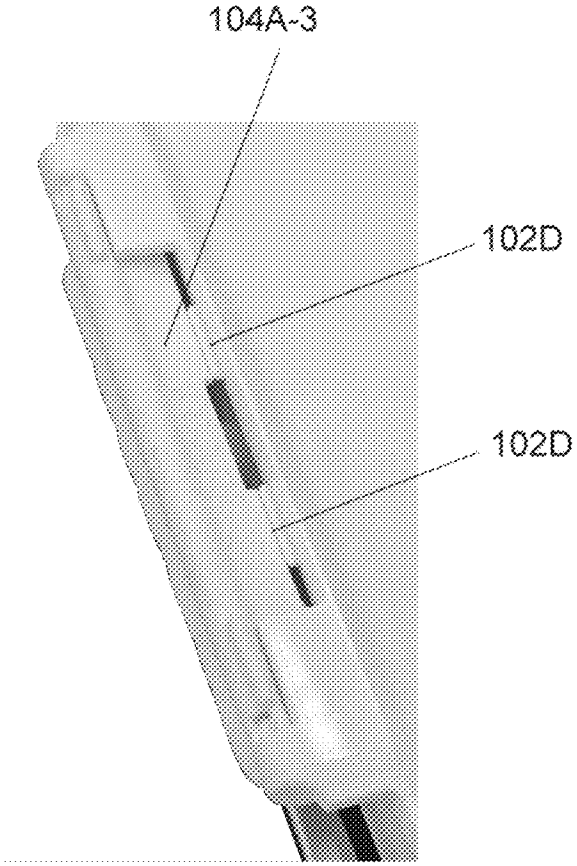
Figure 9C:
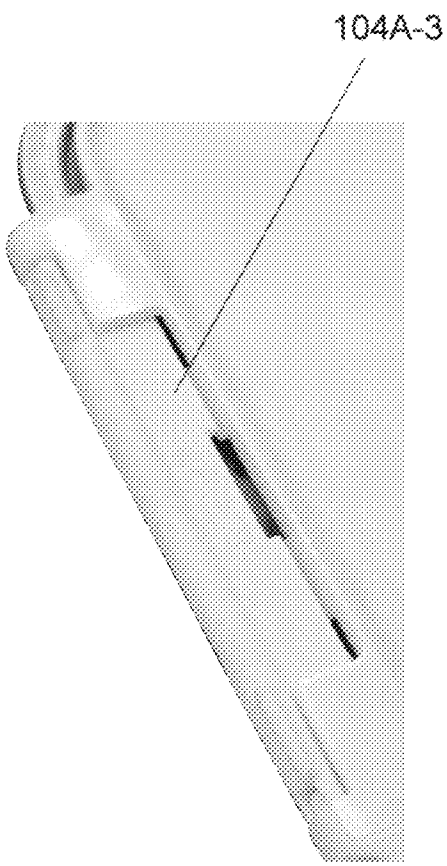
Figure 10A:
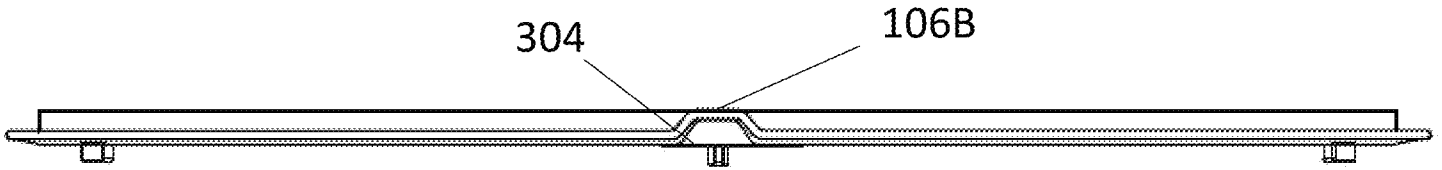
FIGS. 10A-10C show the deformation of a sealing element during compression.
Figure 10B:
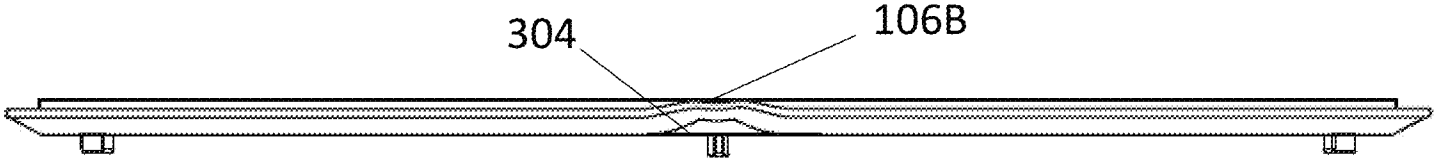
Figure 10C:
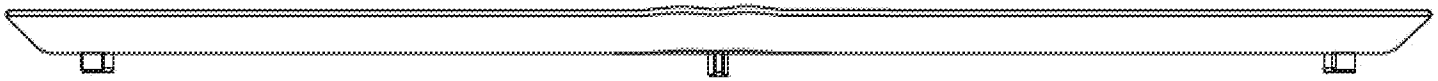
Figure 11A:
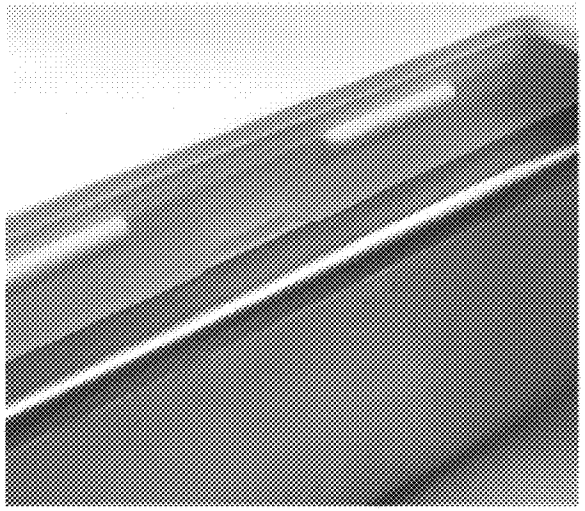
FIGS. 11A-11D show the deformation of a skirt of a scaling element during the closure means is in use.

The closing of the closure means 100 can be divided into 3 stages. For illustration, please refer to the prototype in FIGS. 9A-9C. FIG. 9A illustrates the closure means 100 is placed over the container 300. Firstly, the lower plate 102B of the lid cover 102 aligns with the edge 304 of the container 300, establishing a substantially level surface. The flipping portion 104A-3 of the lid cover rests on the edge 304 of the container, with little or no contact between the underside of the flipping portion and the container's edge. In some embodiments, the flipping portion 104A-3 stands on the edge 304 of the container 300. The meaning of "stand" is that the substantial portion or even the entire underside of the flipping portion 104A-3 is not in contact with the edge of the container. Furthermore, the flipping portion 104A-3 remains separated from the tooth member 102D, with the tooth member positioned above it. This configuration signifies that the closure means 100 is considered unsealed. Notably, the sealing element 106 plays a critical role in this state as well. Specifically, the skirt 106A of the sealing element abuts the inner edge of the container's cavity, ensuring a snug fit. Additionally, the skirt 106A is dimensioned to fit into the narrow gap between the edge of the cavity and the lower plate 102B. To further illustrate the state of the sealing element 106, FIGS. 10A and 11A showcase the positioning of the crest 106B, while FIGS. 10A-C focus solely on the sealing element 106 for brevity's sake. Together, these details provide a comprehensive understanding of the lid assembly's configuration and the role of the sealing element in FIG. 9A. When a downward force is applied to the closure means 100 depicted in FIG. 9A, the lower plate 102B of the lid cover sinks slightly into the cavity of the container 300. This results in the state shown in FIG. 9B, where the lower plate 102B is positioned below the edge 304 of the container 300. The flipping portion 104A-3 of the wing member comes into contact with (adjoining side by side) and abuts the tooth member 102D, with the underside of the flipping portion 104A-4 engaging the edge 304 of the container 300. This arrangement ensures a close alignment between the flipping portion 104A-3 and the tooth member 102D. The closure means 100 is referred to as quasi-sealed. "Quasi-sealed" means the state of the closure means that resembles or approximates a sealed condition but may not be entirely stable or permanent, since the finger 104A-7 is not engaged with the collar 302 of the container 300. The user can open the closure means 100 without unlocking the lock mechanism. The state of the sealing element 106, particularly the position of the crest 106B, is shown in FIG. 10B. During the transition from FIG. 9A to FIG. 9B, most of the air inside the container 300 is expelled through the aperture formed between the crest 106B of the sealing element and the edge 304 of the container. When a downward force is further applied to the closure means 100 in FIG. 9B, it undergoes further changes. The lower plate 102B of the lid cover sinks slightly deeper into the container 300, positioning itself even further below the edge 304. Simultaneously, the flipping portion 104A-3 at least partially covers the tooth member 102D, which prevents the wing member 104A from pivoting upwards. This configuration signifies that the closure means 100 is now sealed. "Sealed" means the contents of the container 300 are effectively isolated from the surrounding atmosphere. The user can open the closure means 100 by unlocking the lock mechanism(s). Notably, the sealing element 106, specifically the state of the crest 106B, is depicted in FIG. 10C, providing a visual representation of its position and sealing effectiveness in the closure means 100. It shall be understood that the interaction between the flipping portion 104A-3 and the tooth member 102D defines another lock mechanism to prevent the closure means 100 disengages with the container 300 after the closure means 100 closes (or seals) the container 300. It shall also be understood that at the state when the flipping portion 104A-3 at least partially covers the tooth member 102D, the gas evacuation out of the container is the maximum. The tooth member covered by the flipping portion provides a locking effect that it prevents the closure means after sealed moving upwards due to the increased internal pressure developed by the spoiled gas evolved from the food stored inside the container.

Figure 11B:
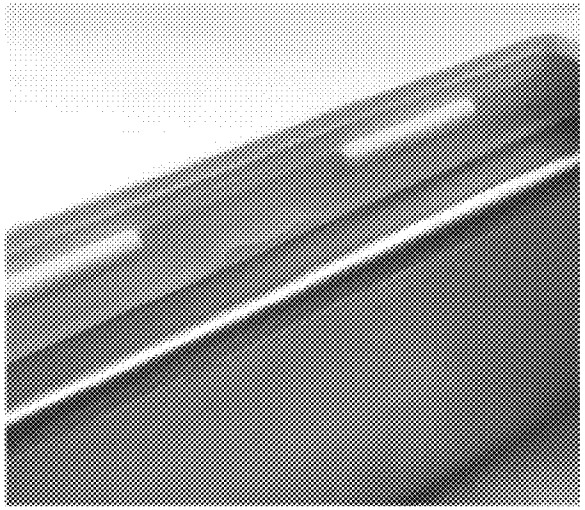
Figure 11C:
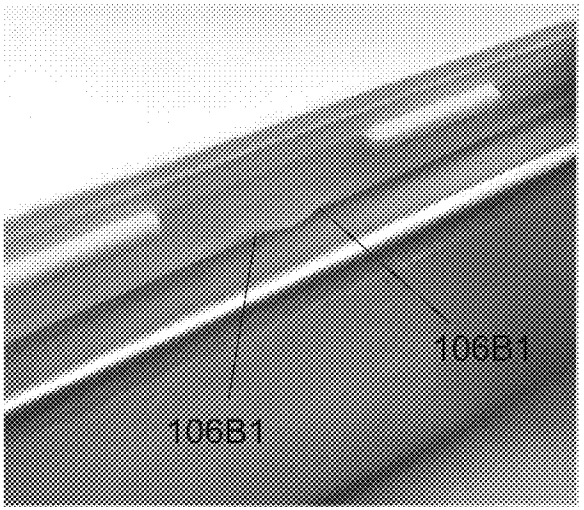
Figure 11D:
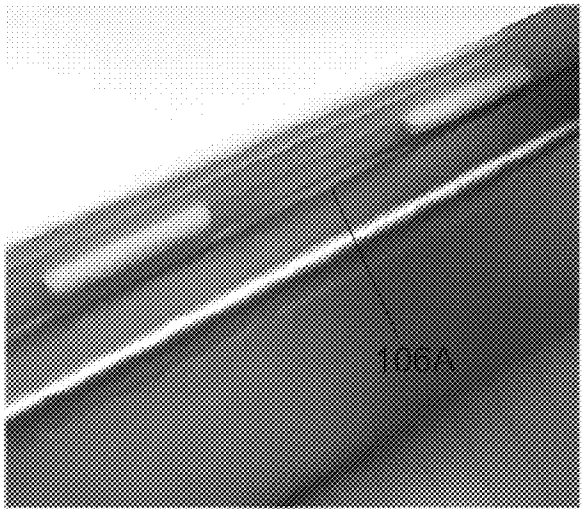

FIGS. 11A-D illustrate the progressive changes in the shape of the crest 106B of the sealing element 106 in a prototype. In FIG. 11A, the lid cover 102 is in its unsealed state, indicating that it is not yet fully closed. FIGS. 11C-D demonstrate the lid cover 102 being pushed further downwards until it reaches the sealed state in FIG. 11D. FIGS. 11B-C depict the lid cover 102 in its "Quasi-sealed" state, which is an intermediate stage between unsealed and sealed. Notably, FIG. 11C reveals an important aspect where the crest 106B undergoes deformation as a result of the downward motion of the lid cover 102. This deformation leads to the formation of two apertures, referred to as 106B1, between the skirt 106A of the crest 106B and the edge 304 of the container. These apertures serve a crucial purpose by facilitating the evacuation of gas from the container while simultaneously providing substantial sealing of the contents stored inside from the surrounding atmosphere. When the lid cover 102 is in its sealed state, it can be observed that only a portion of the skirt 106A of the crest 106B slightly protrudes outwardly or is exposed. This observation highlights the sealing effectiveness of the closure means, where the protrusion indicates a secure closure and isolation of the container's contents.

Due to the sealing effectiveness, it shall be understood that even if the closure means is not provided with the three lock mechanisms as described above, i.e., the interaction between the collar 302 and the finger 104A-7 defines a lock mechanism; the interaction between the collar 302 and the elevation 104A-8 defines another lock mechanism; and the interaction between the flipping portion 104A-3 and the tooth member 102D, the closure means after sealing to the container is still secured since the internal pressure of the container is less than the atmospheric atmosphere. The atmospheric pressure will exert a downward force on the lid cover. Therefore, for the illustrations in FIG. 8D-3, FIGS. 8E-1-8E-6, FIG. 8F-1-8F-6, and FIGS. 8G-1-8G-6, notwithstanding these illustrations are not provided with the lock mechanisms, the closure means in these illustrations will not be opened easily after sealing to the container.

Figure 12A:
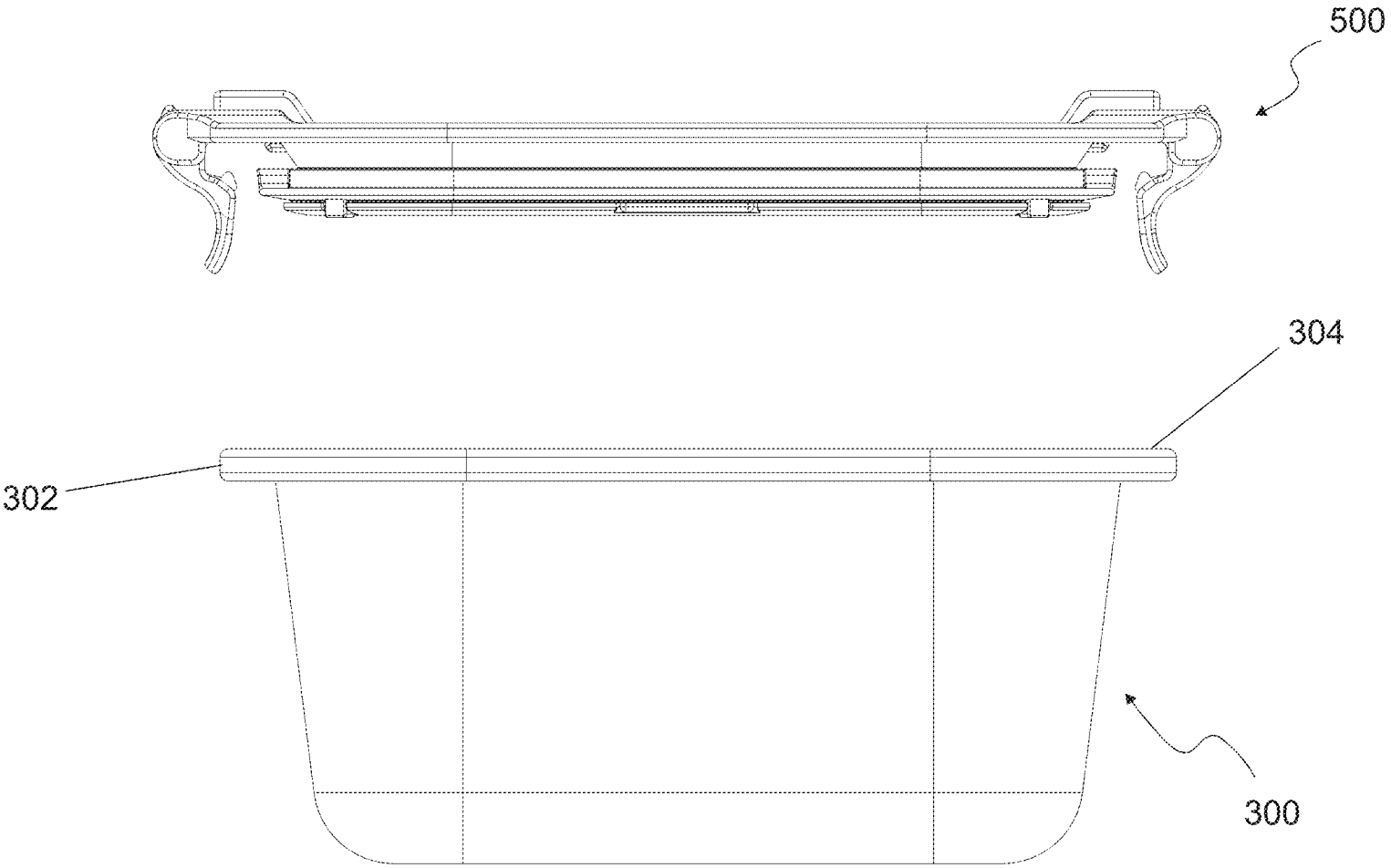
FIG. 12A shows a second embodiment of a closure means.
Figure 12C:
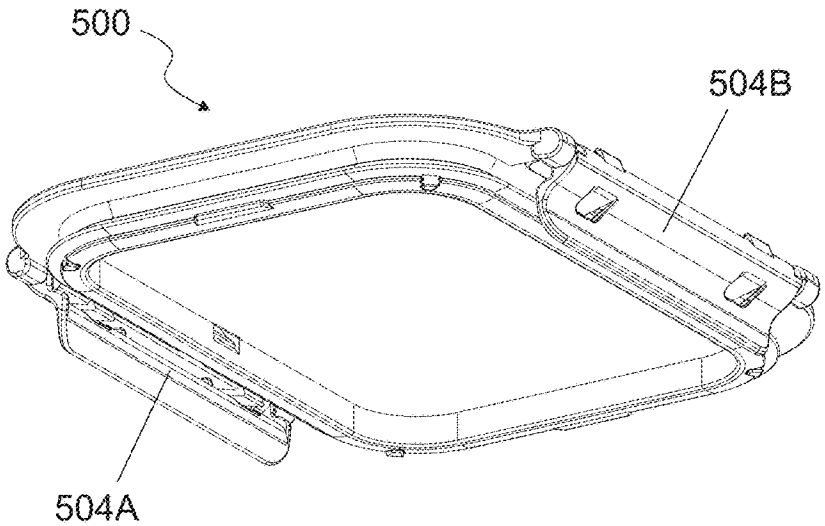
FIGS. 12B and 12C show the second embodiment of a closure means with different views.
Figure 12B:
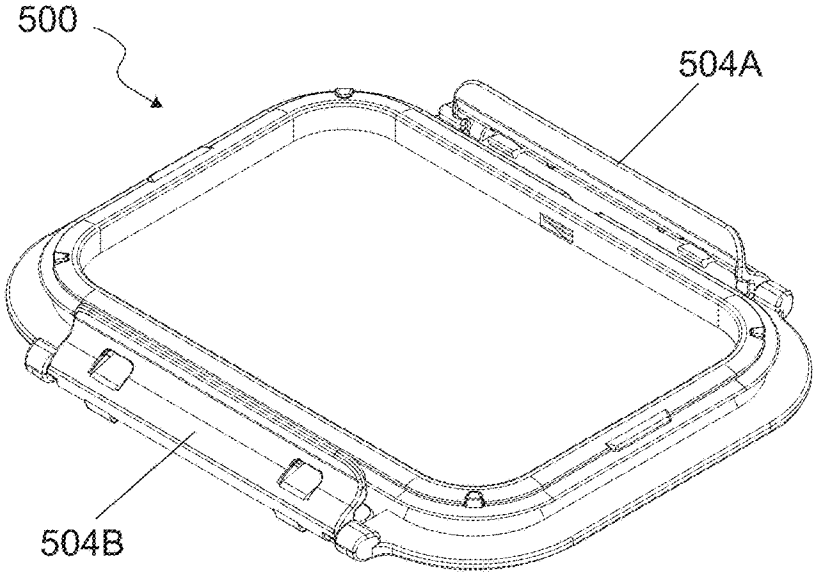
Figure 13:
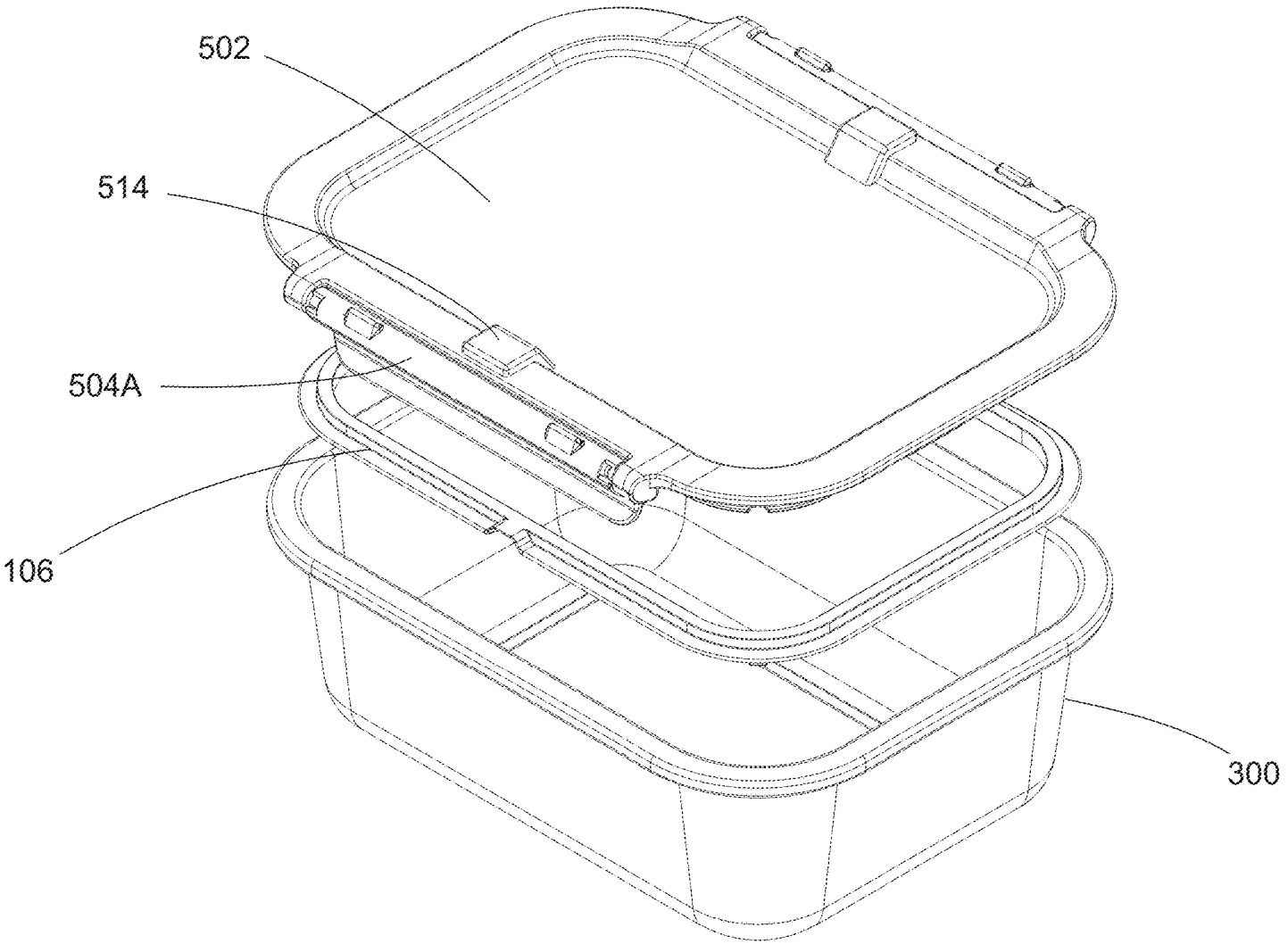
FIG. 13 shows a lid assembly of the second embodiment, a scaling element and a container.
Figure 14:
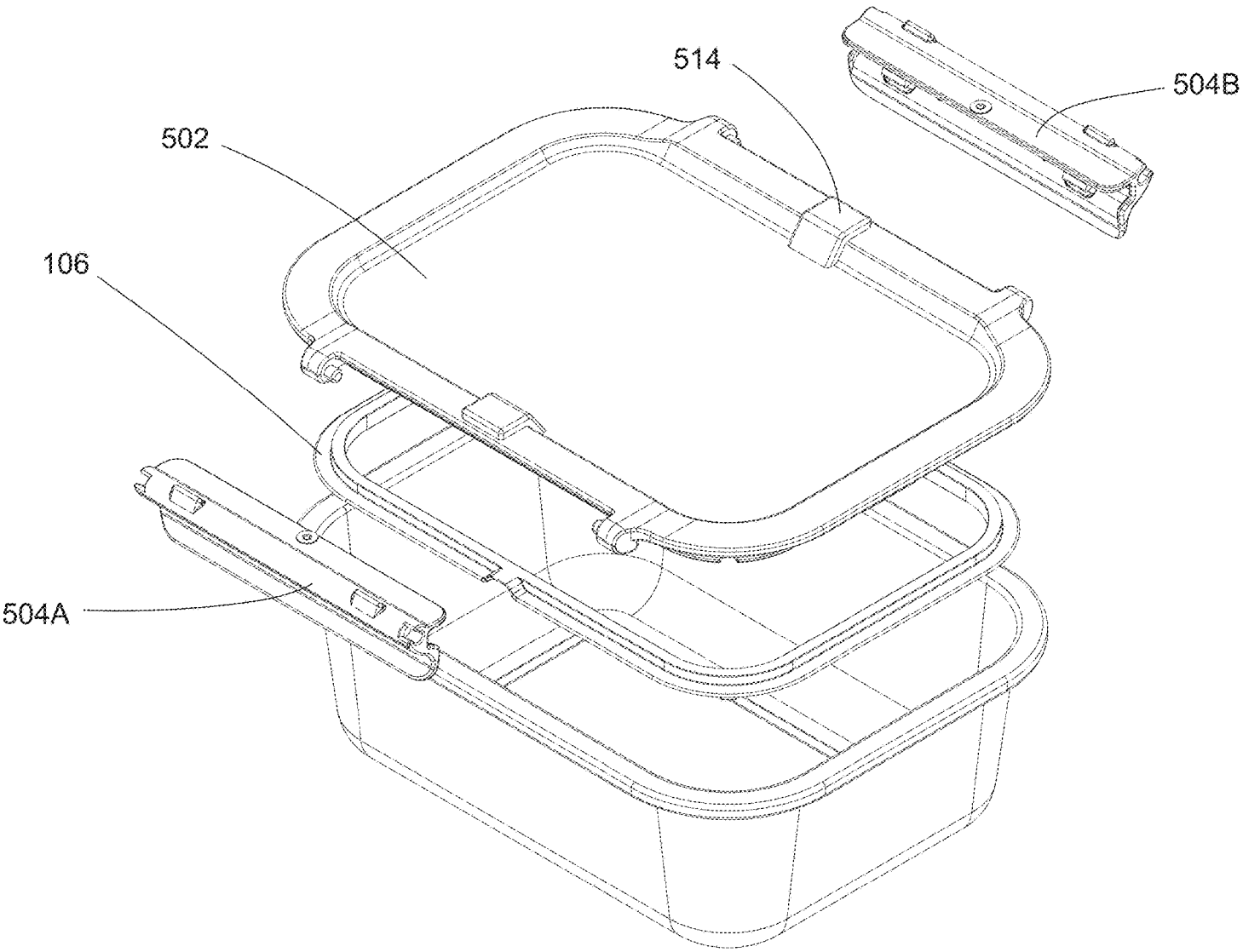
FIG. 14 shows the exploded view of a lid assembly of the second embodiment, a sealing element and a container.

FIG. 12A shows a second embodiment of the closure means 500 and the container 300. FIGS. 12B and 12C show the closure means 500 in different views, in which the closure means 500 is provided with a first wing member 504A and a second wing member 504B. FIG. 13 shows clearly the container 300, a lid cover 502, the first wing member 504A, and the sealing element 106. As seen, the sealing element in FIG. 13 is the same as the first embodiment that uses the sealing element 106. Therefore, the second embodiment of the closure means 500 differs from the first embodiment of the closure means 100 in that the second embodiment of the lid assembly differs from the first embodiment of the lid assembly. For the sake of brevity, only the differences between the first embodiment and the second embodiment of the lid assembly will be described in details as below. In the second embodiment of the lid assembly, it provides with the lid cover 502, the pair of wing members 504A and 504B, and a gas channeling means. Apparently, the lid cover 502 and the wing members 504A and 504B are the second embodiments of the lid cover and the wing member of the present invention. FIG. 14 is an exploded view of the closure means 500 comprising the lid assembly and the sealing element.

Figure 15A:
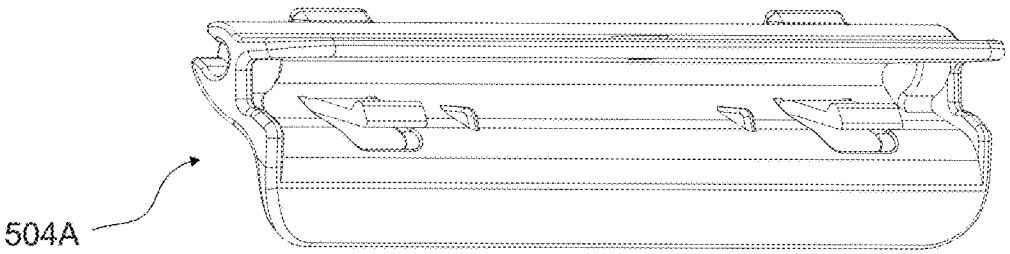
FIGS. 15A-E show a second embodiment of a wing member.
Figure 15B:
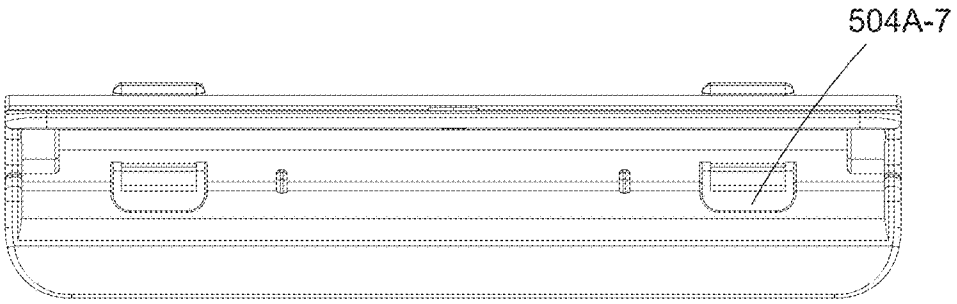
Figure 15C:
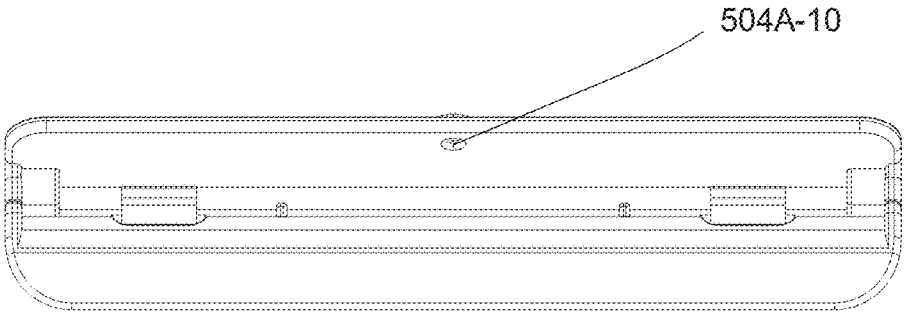
Figure 15E:
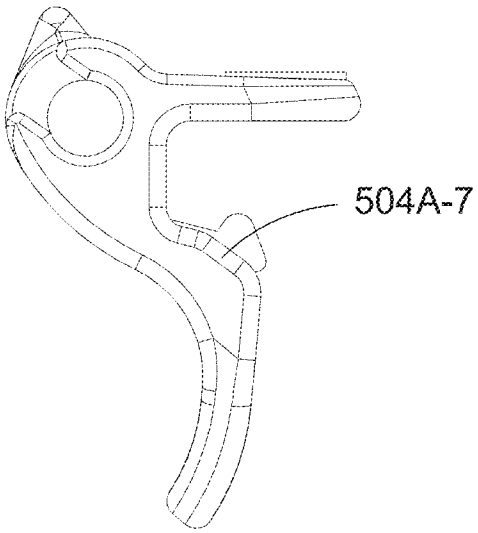
Figure 15D:
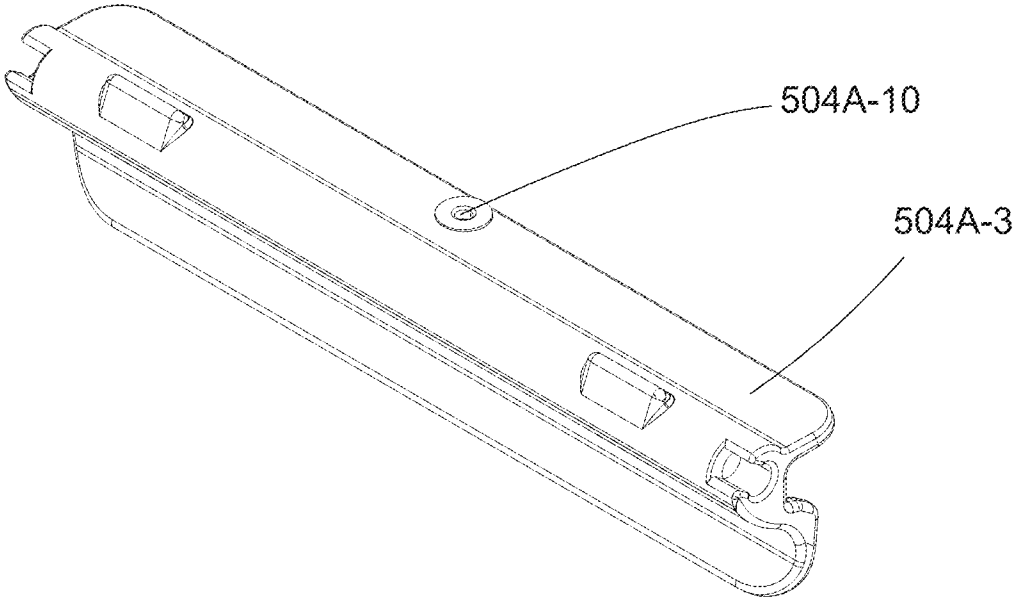

FIGS. 15A-E illustrate the second embodiment of the first wing member 504A. The configuration of the first wing member 504A is substantially the same as that of the first wing member 104A, except for a flipping portion 504A-3, which is provided with an aperture 504A-10 in the middle. As seen in FIG. 15C, the aperture 504A-10 is a throughhole. In some embodiments, the aperture 504A-10 can work with a gas valve. In the second embodiment of the present invention, the aperture 504A-10, the gas valve, and the gas channeling member 514 define a gas channeling means for the second embodiment of the lid assembly.

Figure 16B:
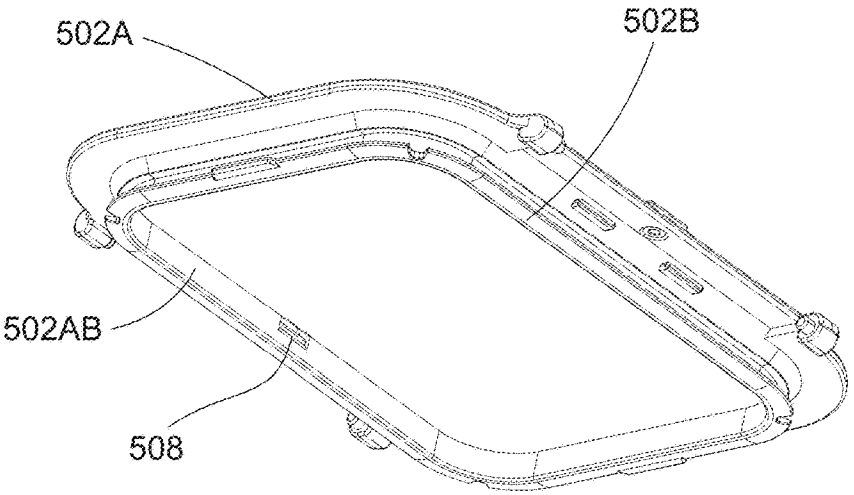
FIGS. 16A-D show a second embodiment of a lid cover.
Figure 16A:
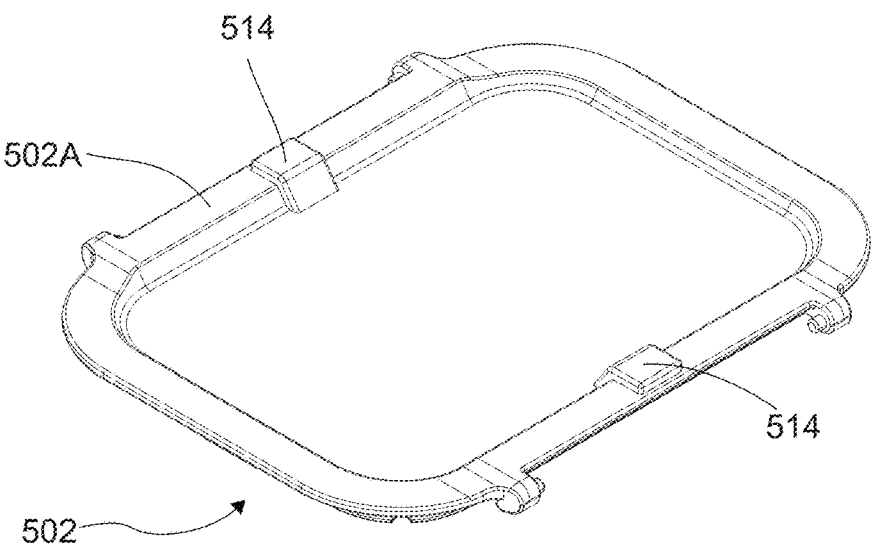
Figure 16D:
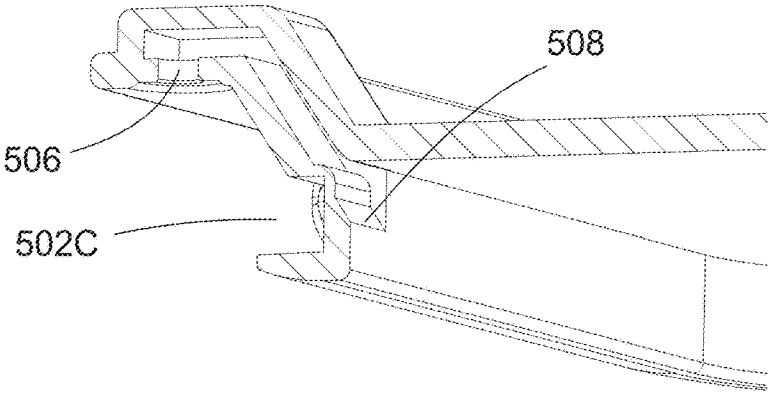
Figure 16C:
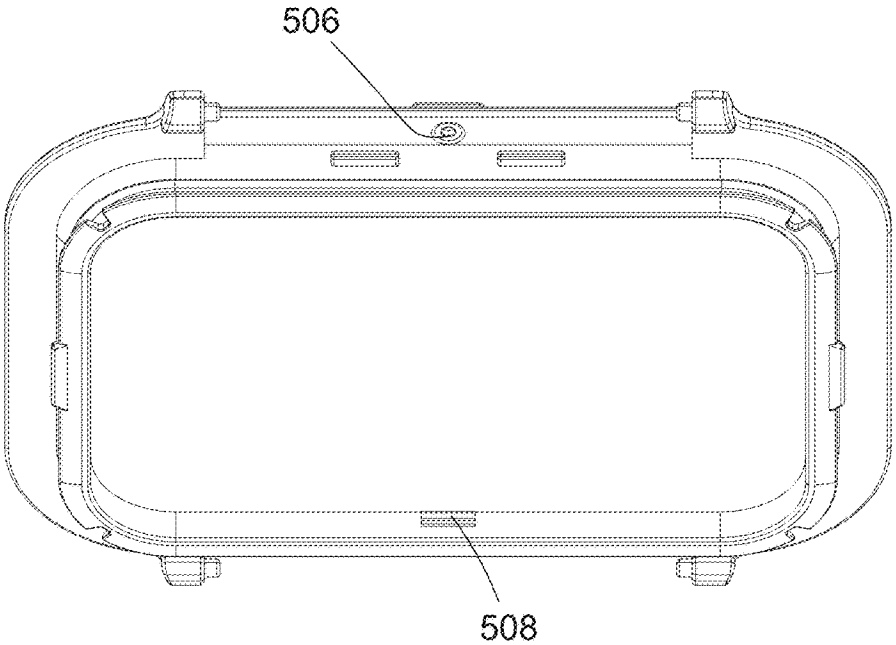

FIGS. 16A-16D show the lid cover 502, which is configured to provide an upper plate 502A and a lower plate 502B connecting said upper plate 502A via standing wall 502AB, which defines a groove 502C therebetween. The configuration of the lid cover 502 is substantially the same as the lid cover 102, except the lid cover 502 is provided with the gas channeling member 514 which is defined by a gas channel between a first opening 506 and a second opening 508, as illustrate in FIG. 16D. The first opening 506 is positioned on the upper plate 502A and the second opening is positioned on the standing wall 502AB. As seen in FIG. 16A, there are two gas channeling members 514. The number of disclosed gas channeling member shall not be any limitation to the present invention. By definition, the "gas channel" in the present invention is a channel enable fluid communication between the internal cavity of the container and the atmosphere and is not only limited with the features described herein.

Figure 17B:
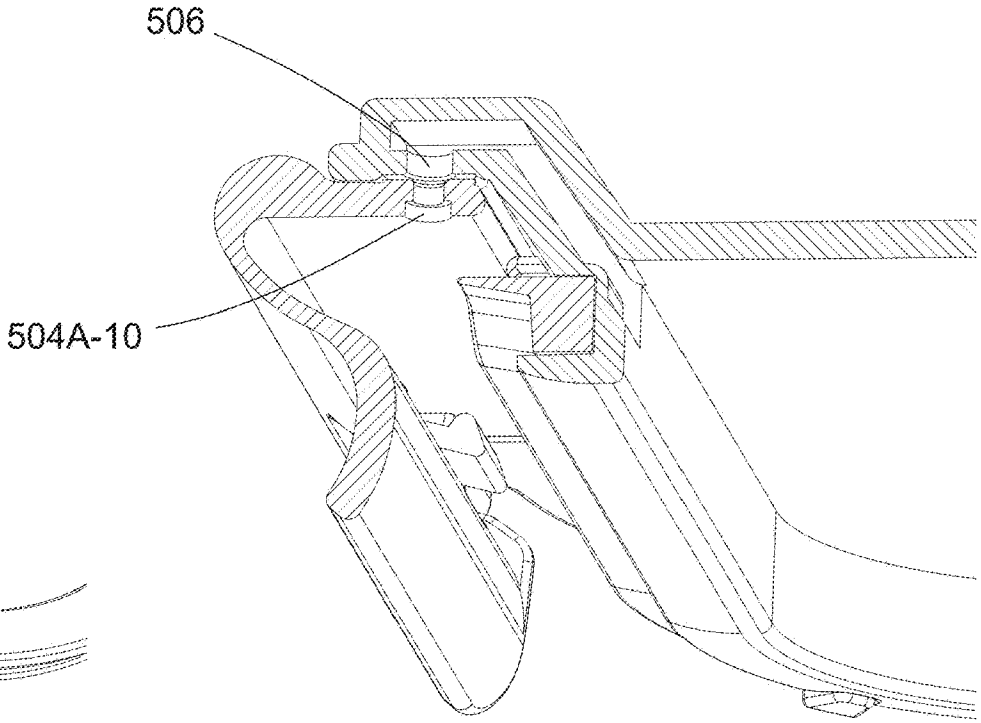
FIGS. 17A and 17B show the assembly between a first wing member and a lid cover of the second embodiment.
Figure 17A:
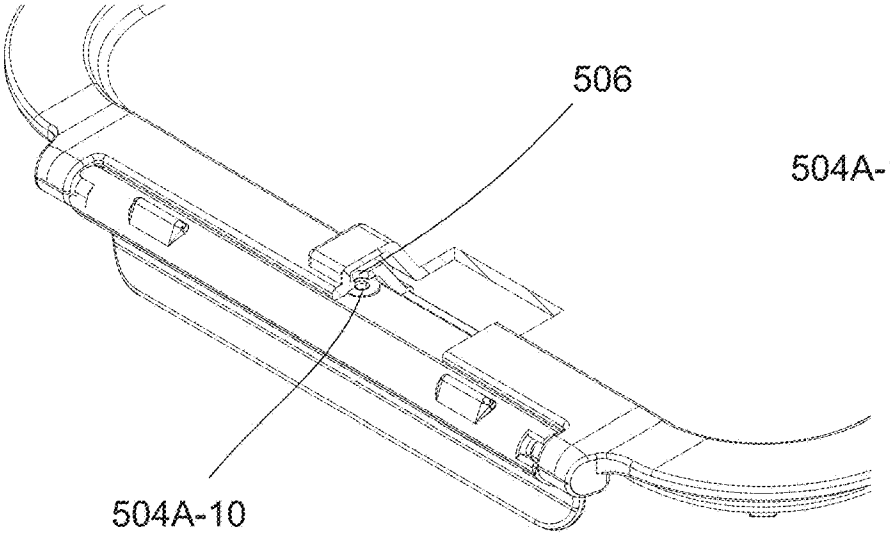
Figure 18C:
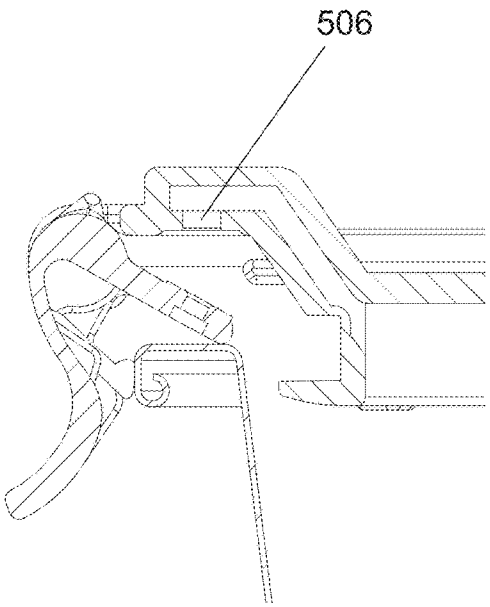
FIGS. 18A-C show a lid cover in different sealing conditions.
Figure 18B:
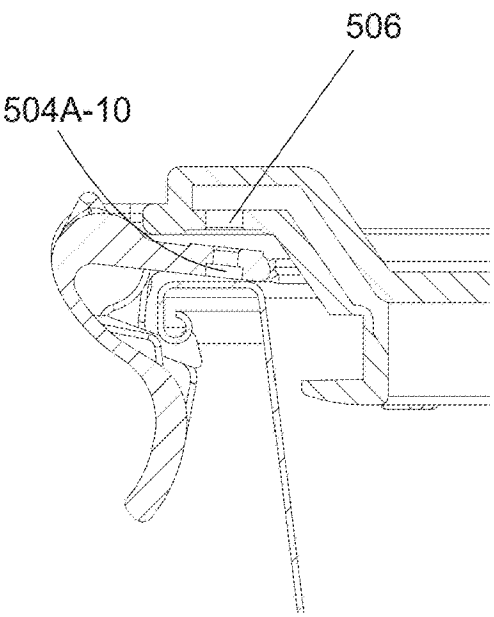
Figure 18A:
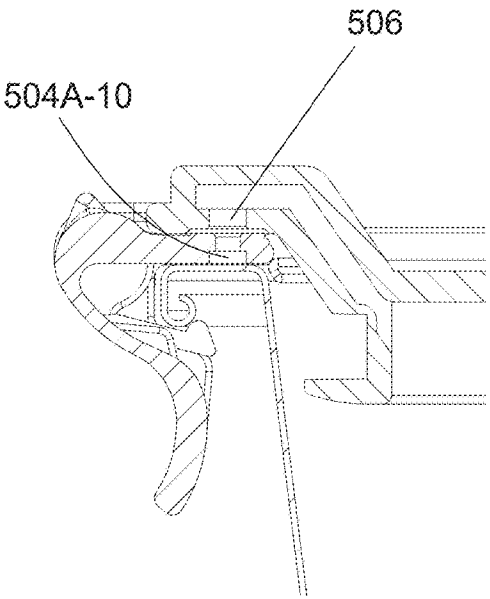

FIGS. 17A and 17B illustrate the assembly between the first wing member 504A and the lid cover 502, in which some of the regions are cut out for illustration. As seen, the first opening 506 abuts the aperture 504A-10. In FIGS. 17A-17B, there is a fluidic communication between aperture 504A-10 and the gas channel defined by the communication between the first and the second openings 506 and 508. However, it shall be understood that when the closure means of the second embodiment is in use, a gas valve is installed in the aperture 504A-10. FIGS. 18A to 18C illustrate the closure means 500 is in sealed state (FIG. 18A), quasi-sealed state (FIG. 18B), and unsealed state (FIG. 18C). For brevity's sake, the gas valve, that should be installed in the aperture 504A-10 when the closure means 500 is in use, is not shown.

Figure 19:
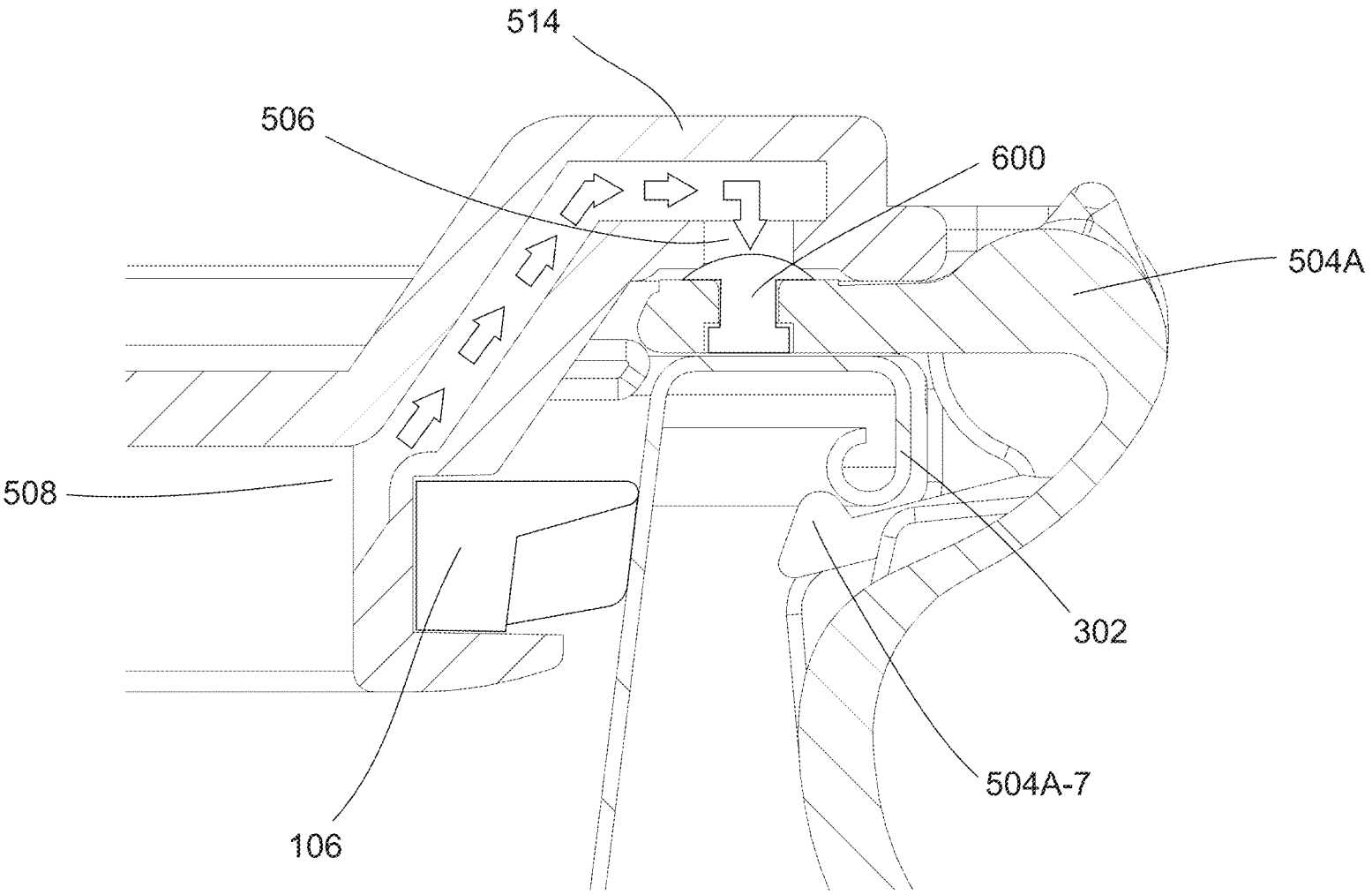
FIG. 19 is a schematic drawing showing how gas is channeled through the gas channeling means, during closing the container with the closure means.
Figure 20:
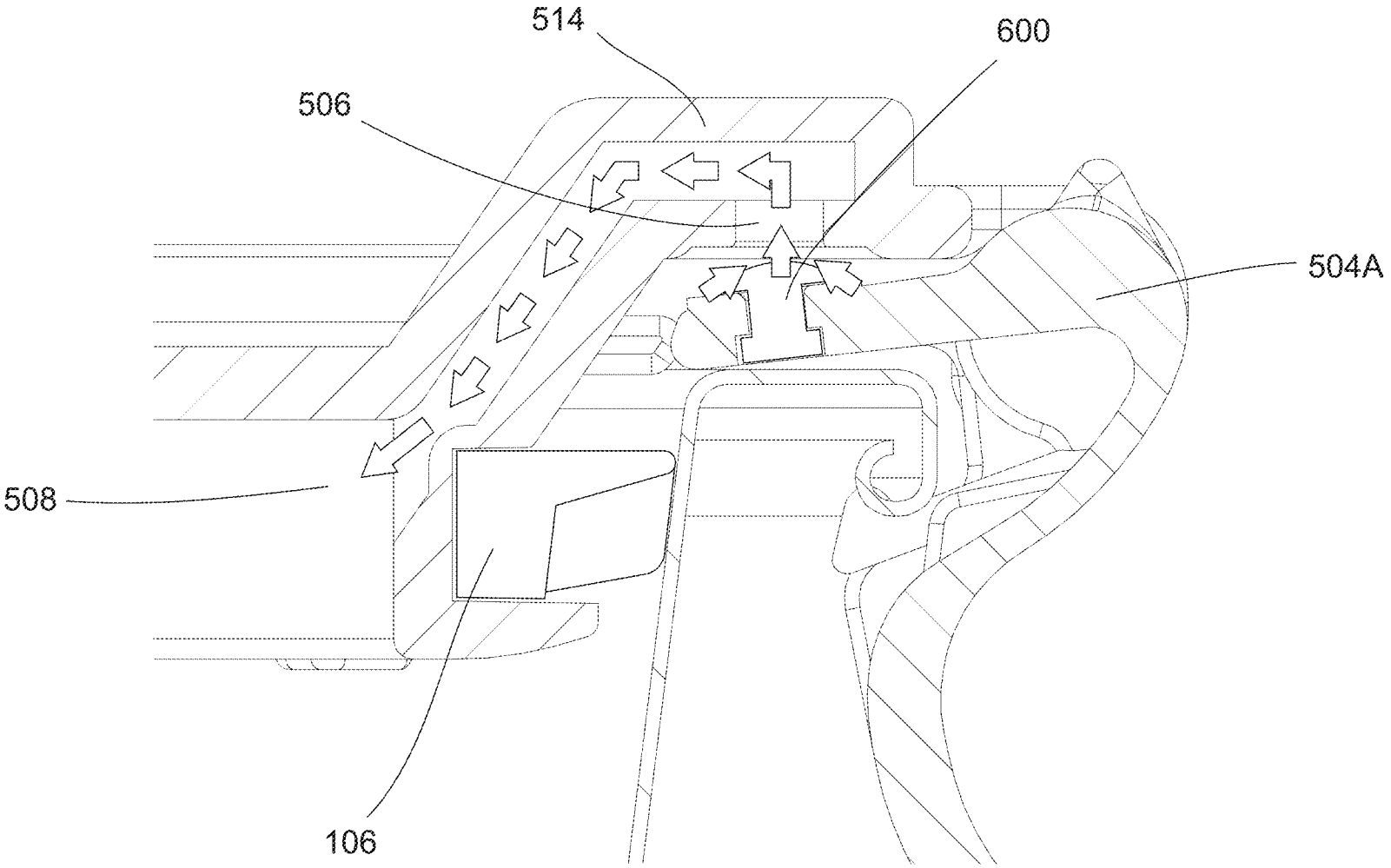
FIG. 20 is a schematic drawing showing how gas is channeled through the gas channeling means, during opening said container that is closed with said closure means.

FIG. 19 illustrates the gas flow when the closure means 500 is sealing to the container. As seen, the finger 504A-7 engages with the collar 302 of the container 300. As also seen, the arrows in FIG. 19 shows how the gas or the pressure inside the container is expelled away through a gas valve 600 is installed in the aperture 504A-10. It shall be understood that at the state maximum air is expelled away from the container, the aperture 506 presses tightly against the gas valve 600. Meanwhile, the flipping portion of the wing member at least partially covers the tooth member of the lid cover, as described above, whereby preventing the lid cover moving upwards again. FIG. 20 illustrates the gas flow when the closure means 500 is about to unseal the container, i.e. in a process of opening the closure means. As seen, the arrows in FIG. 20 shows how the gas in atmosphere goes inside the container through the gas valve 600. It shall be understood that the gas channeling means in FIGS. 19-20 comprises the gas channel member 514, the aperture 504A-10, and the gas valve 600. It shall be understood that second embodiment of the lid assembly can work well with the sealing element 106 or other conventional sealing element. If the second embodiment of the lid assembly works with the sealing element 106, the deformation of the crest 106B of the sealing element provides a first passageway, as explained above, for evacuating gas from the container, while the gas channeling member means provides another passageway for evacuating gas from the container. It shall also be understood that the first passageway and the second passageway can be practiced independently. Advantageously, experiments show that the second embodiment of the closure means works well for the closure means that is made of plastic, glass, or metal.

Figure 21:
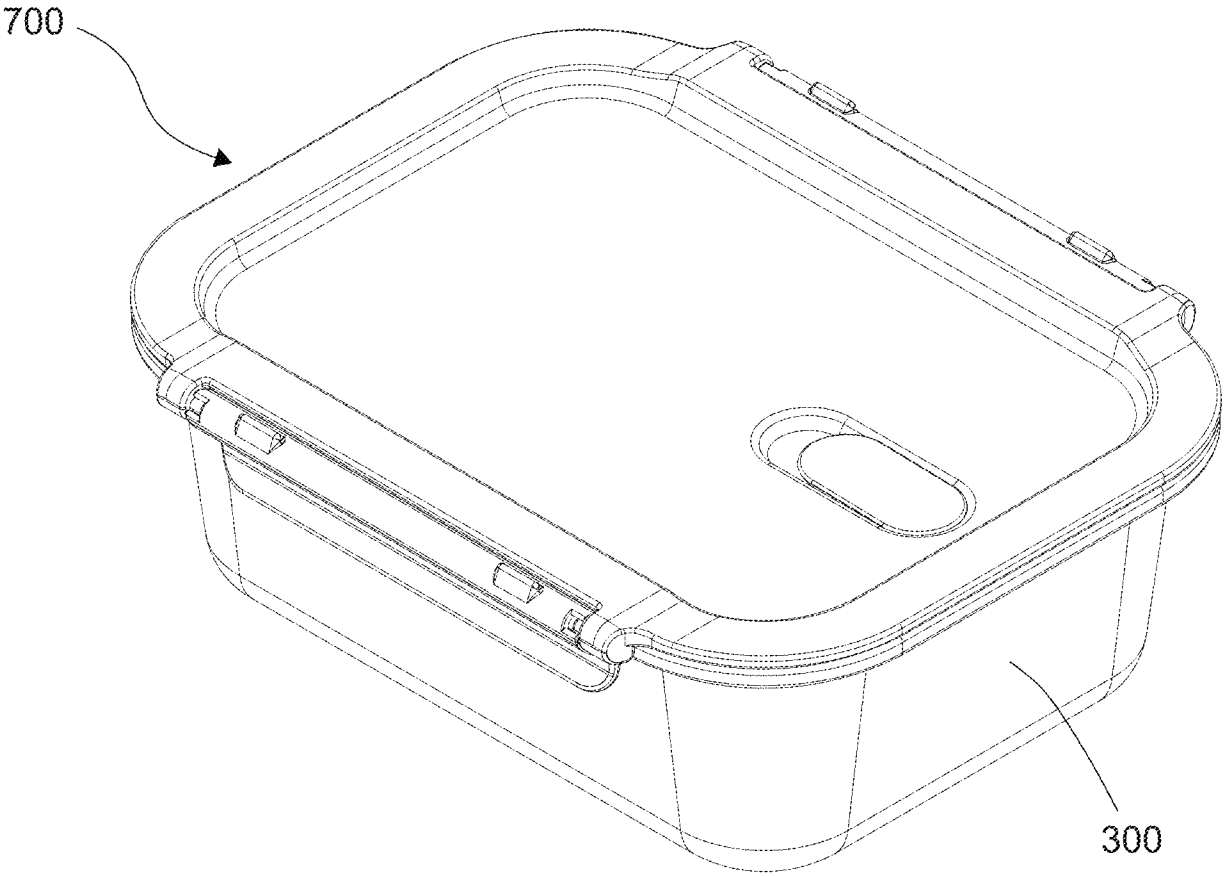
FIG. 21 shows a third embodiment of a closure means sealed to a container.
Figure 22B:
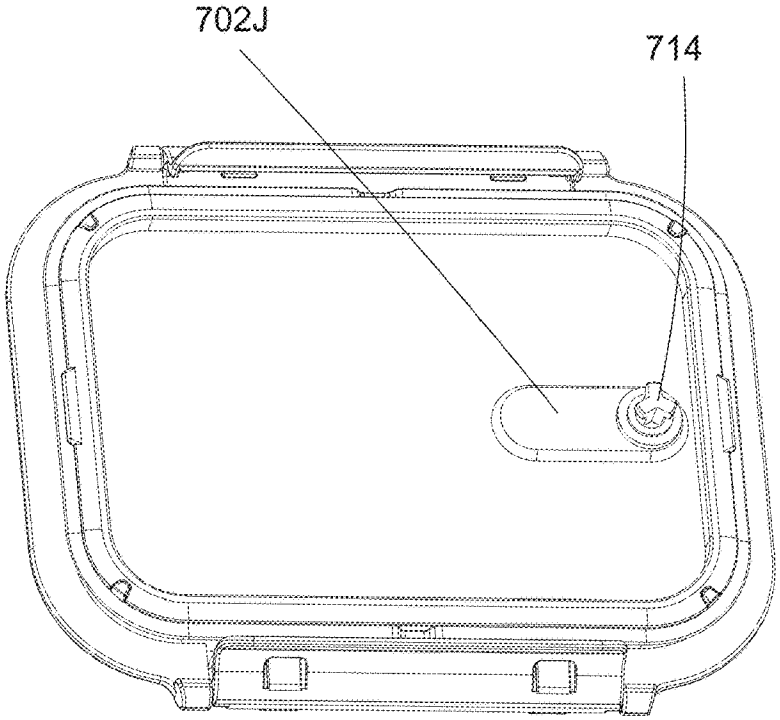
FIGS. 22A-B show the third embodiment of a closure means with different views.
Figure 22A:
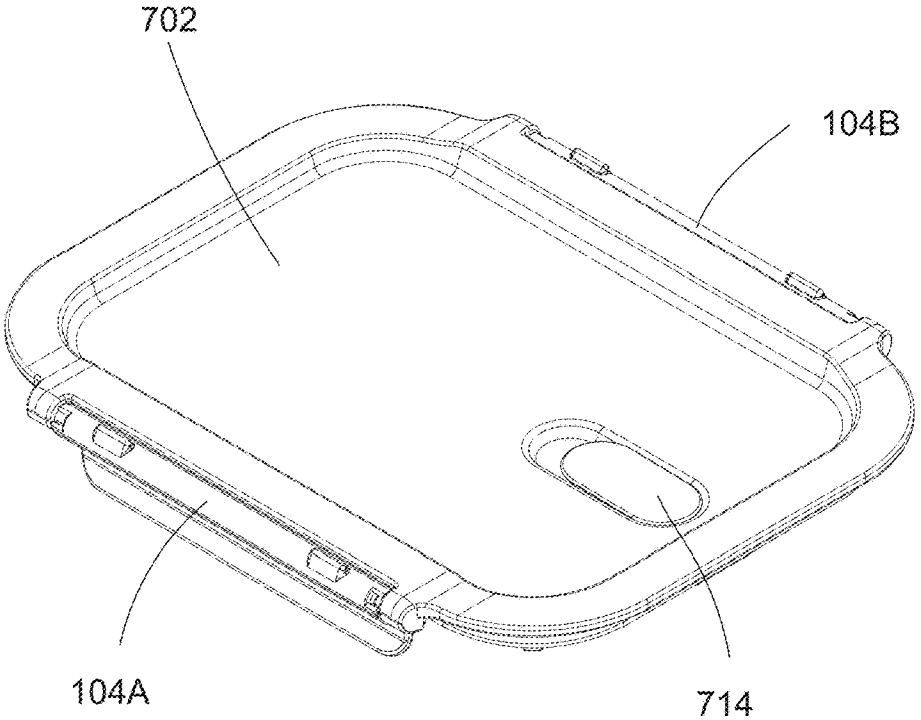

FIG. 21 shows a third embodiment of the closure means 700 sealed to the container 300. For the sake of brevity, only the differences between the previous embodiments and the third embodiment of the closure means will be described in details as below. FIGS. 22A and 22B show the closure means 700 in different views. The sealing element in the third embodiment is the same as the first embodiment that uses the sealing element 106. As seen, the closure means 700 comprises a lid assembly and a sealing element, in which the lid assembly comprises a lid cover 702, a pair of wing members 104A & 104B, and a gas channeling means comprising a gas valve 714. Preferably, at least a portion of the gas valve 714 is made of polymeric material and/or elastic material.

Figure 23:
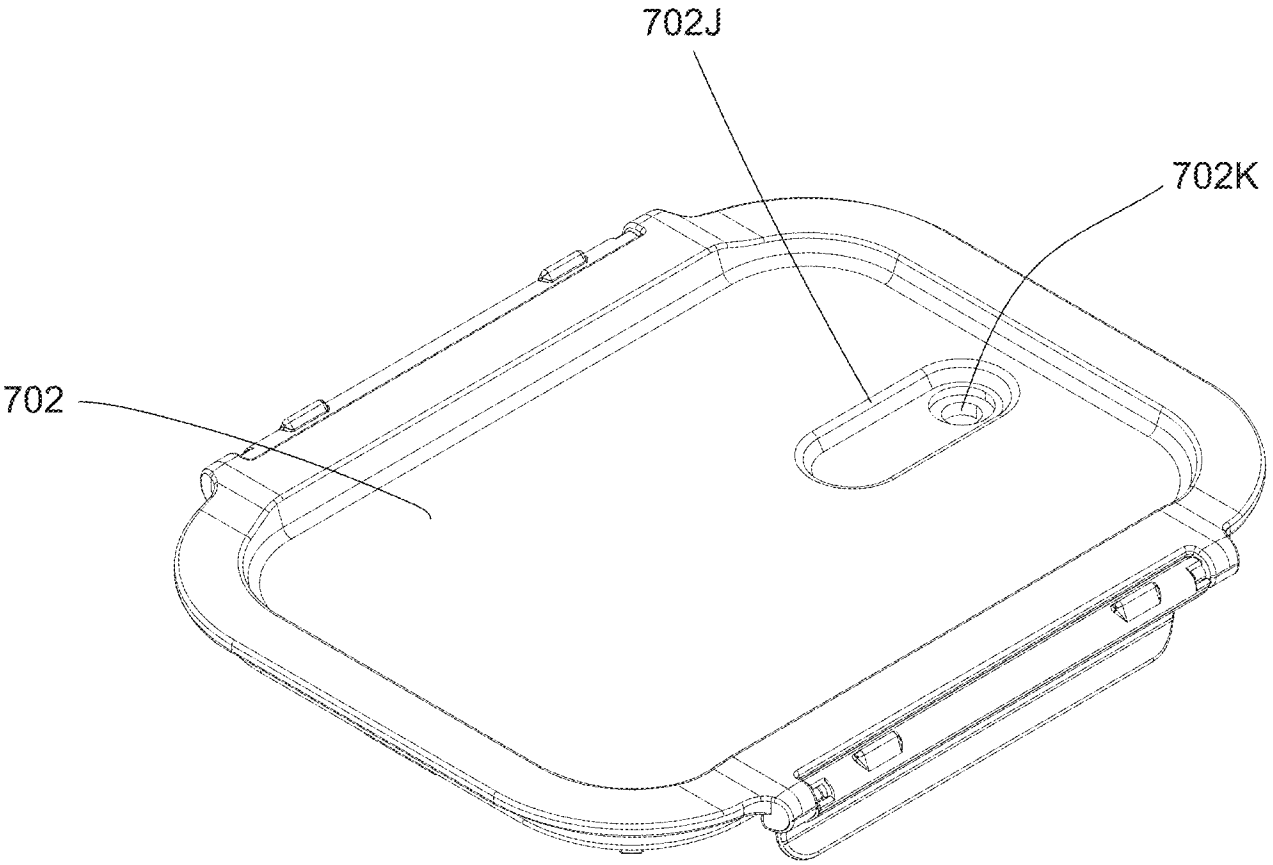
FIG. 23 shows the third embodiment of a lid cover.
Figure 24C:
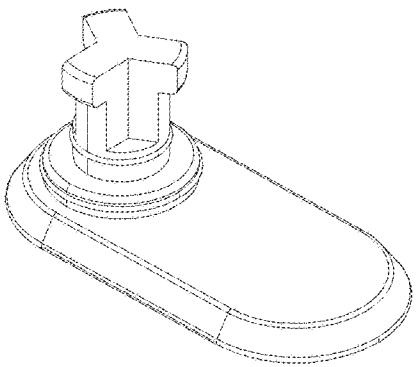
FIGS. 24A-C show a gas valve with different views.
Figure 24B:
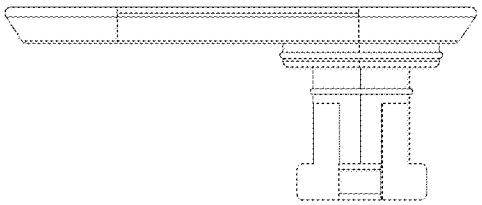
Figure 24A:
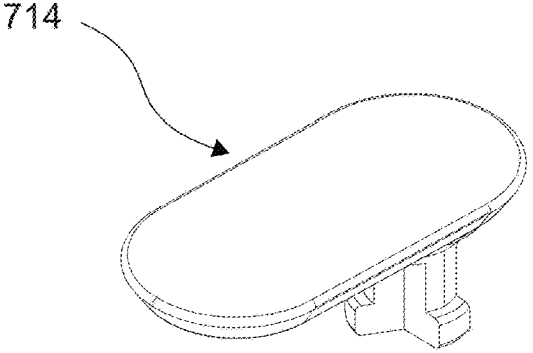

FIG. 23 shows a perspective view of the lid cover 702, revealing a recessed region 702J on its upper surface. Within this recessed region, there is an aperture 702K, which is a through-hole. The aperture 702K is dimensioned to snugly accommodate the gas valve 714. That means, the gas valve can be operably opened and closed, whereby controlling air entering or leaving the container through the gas valve 714. The gas valve 714 and the aperture 702K together define the gas channeling means in this embodiment. FIGS. 24A-24C clearly shows the gas valve 714 with different angles. One shall understand that the illustration of the gas valve 714 in FIGS. 24A-24C is for example only, such illustration shall not be any limitation to the present invention.

In the third embodiment, when a user intends to seal the container with the closure means 700, the gas valve is first opened. Then the user presses the lid cover 702 downwards to seal the container. At this stage, air inside the container will be expelled away through the gas valve 714. After the closure means is locked, as aforementioned described, the user can then close the gas valve 714. When the user intends to open the sealed container, the user can first open gas valve 714, then lift the wing members up to release the container from sealed condition to unseal condition.

It shall be understood that third embodiment of the closure means can work well with the sealing element 106 or other conventional sealing element. If the third embodiment of the closure means works with the sealing element 106, the deformation of the crest 106B of the sealing element provides a first passageway, as explained above, for evacuating gas from the container, while the gas channeling means, defined by the gas valve 714 and the aperture 702K, provide another passageway for evacuating gas from the container. It shall also be understood that the first passageway and the second passageway can be practiced independently. Advantageously, experiments show that the third embodiment of the closure means works well for the closure means that is made of plastic, glass, or metal.

FIGS. 25-28 illustrates a fourth embodiment of the closure means 900 of the present invention.

Figure 25:
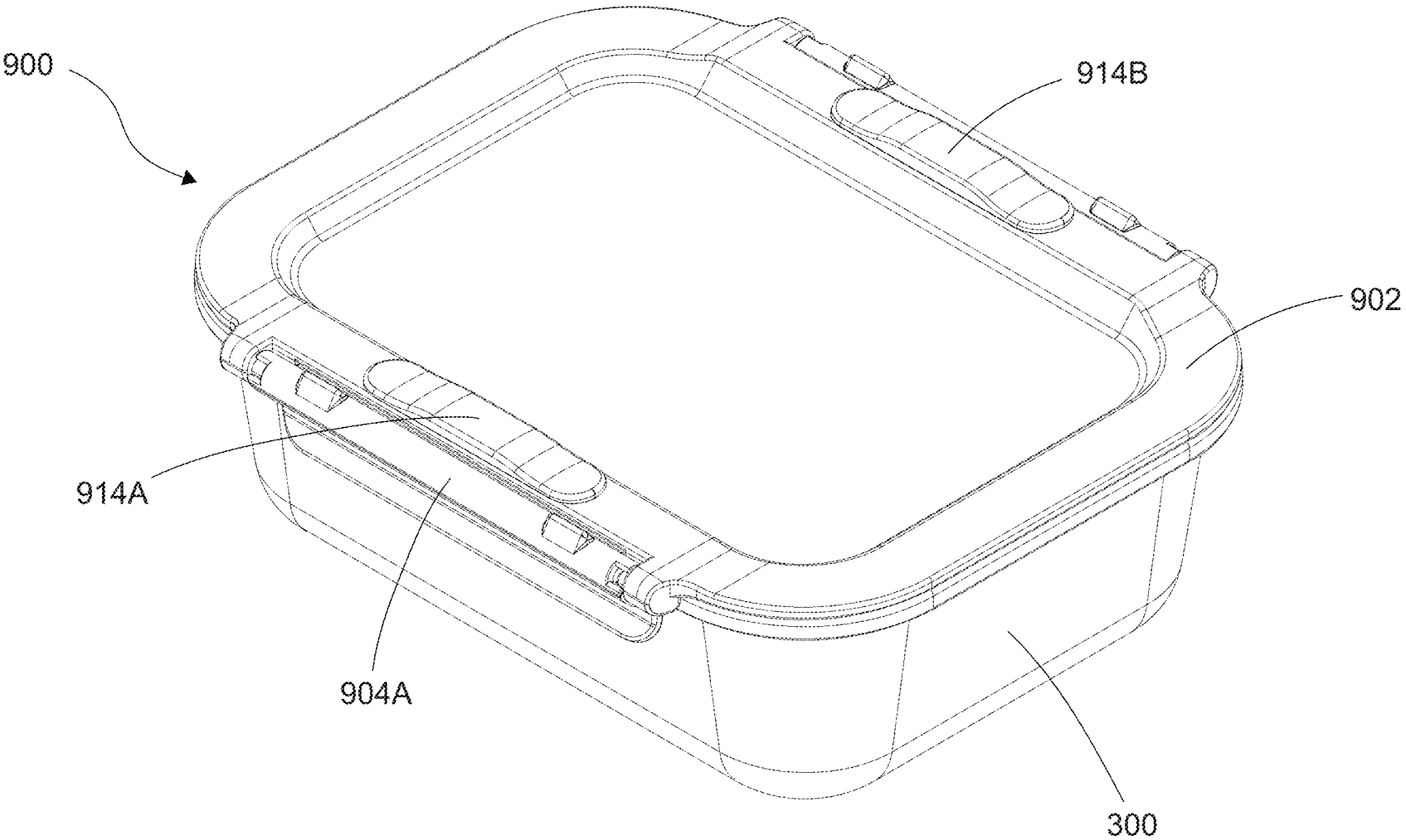
FIG. 25 shows a fourth embodiment of a closure means sealed to a container.

FIG. 25 shows that the closure means 900 seals to the container 300. For the sake of brevity, only the differences between the previous embodiments and the fourth embodiment of the closure means will be described in details as below. As seen, the closure means 900 comprises a lid assembly and a sealing element, in which the lid assembly comprises a lid cover 902, a pair of wing members 904A & 904B, and the gas channeling means as previously described. The closure means 900 further comprises an access means comprising a pair of removable seals 914A and 914B. The access means will be described in details later. The sealing element in FIG. 25 is the same as the one used in previous figures. Certainly, the closure means 900 can use other conventional sealing element available in the market.

Figure 26:
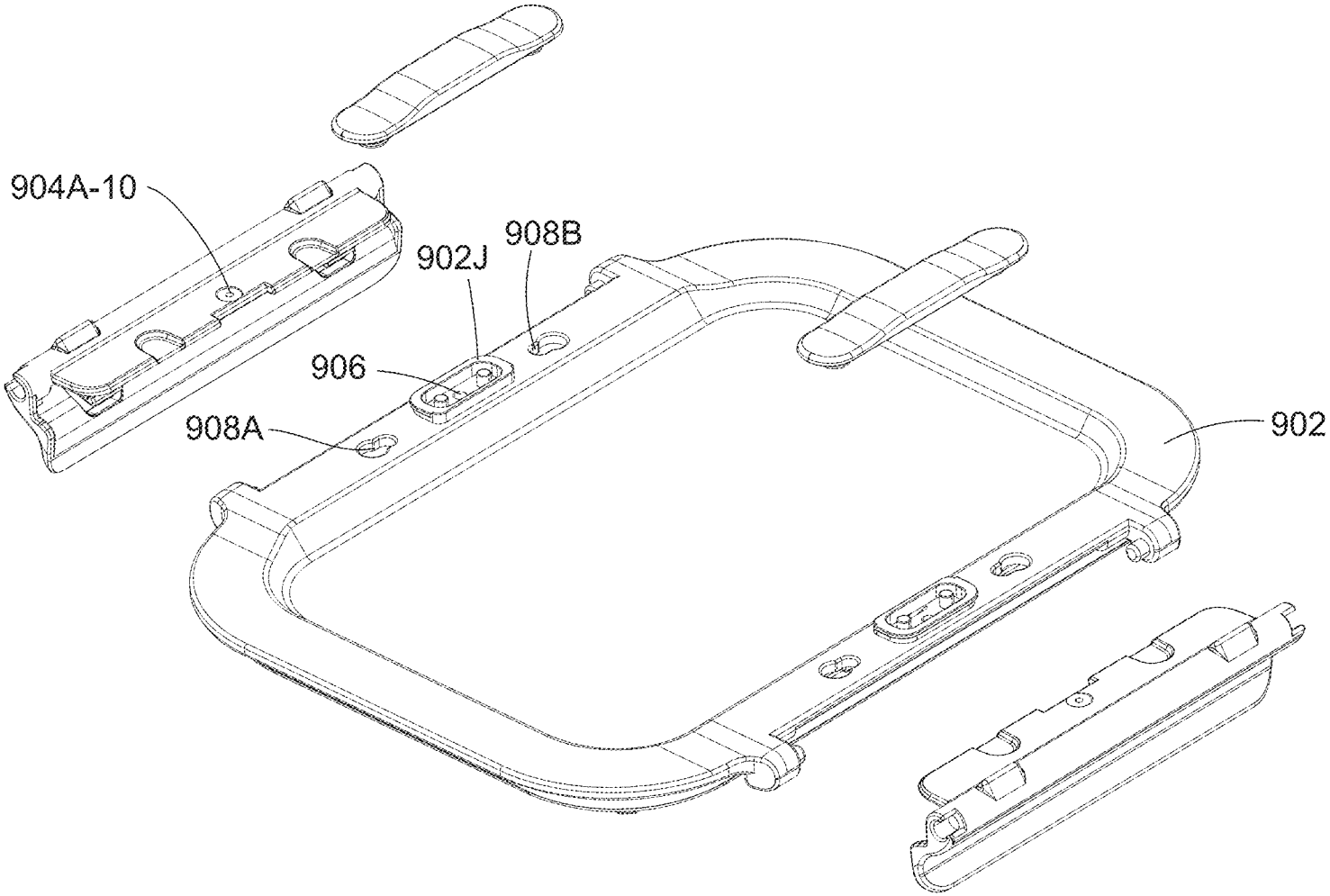
FIG. 26 shows an exploded view of the fourth embodiment of a lid assembly.

FIG. 26 is an exploded view of the fourth embodiment of the lid assembly. Each long edge of the lid cover 902 is provided with a flanged region 902J encompassing the first opening 906, a pair of holes 908A and 908B each positioned one side of the flanged region 902J.

Figure 27C:
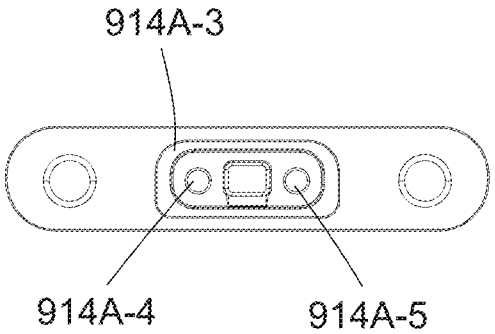
FIGS. 27A-C shows a seal for the closure means in the fourth embodiment with different views.
Figure 27B:
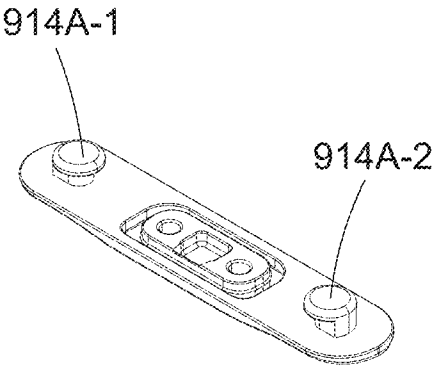
Figure 27A:
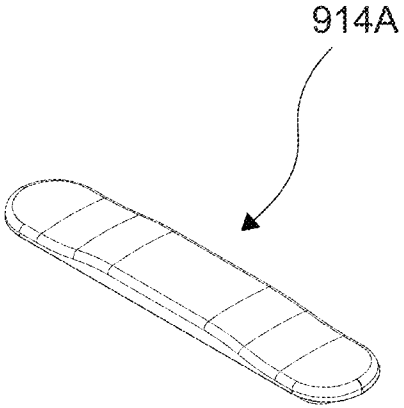
Figure 28:
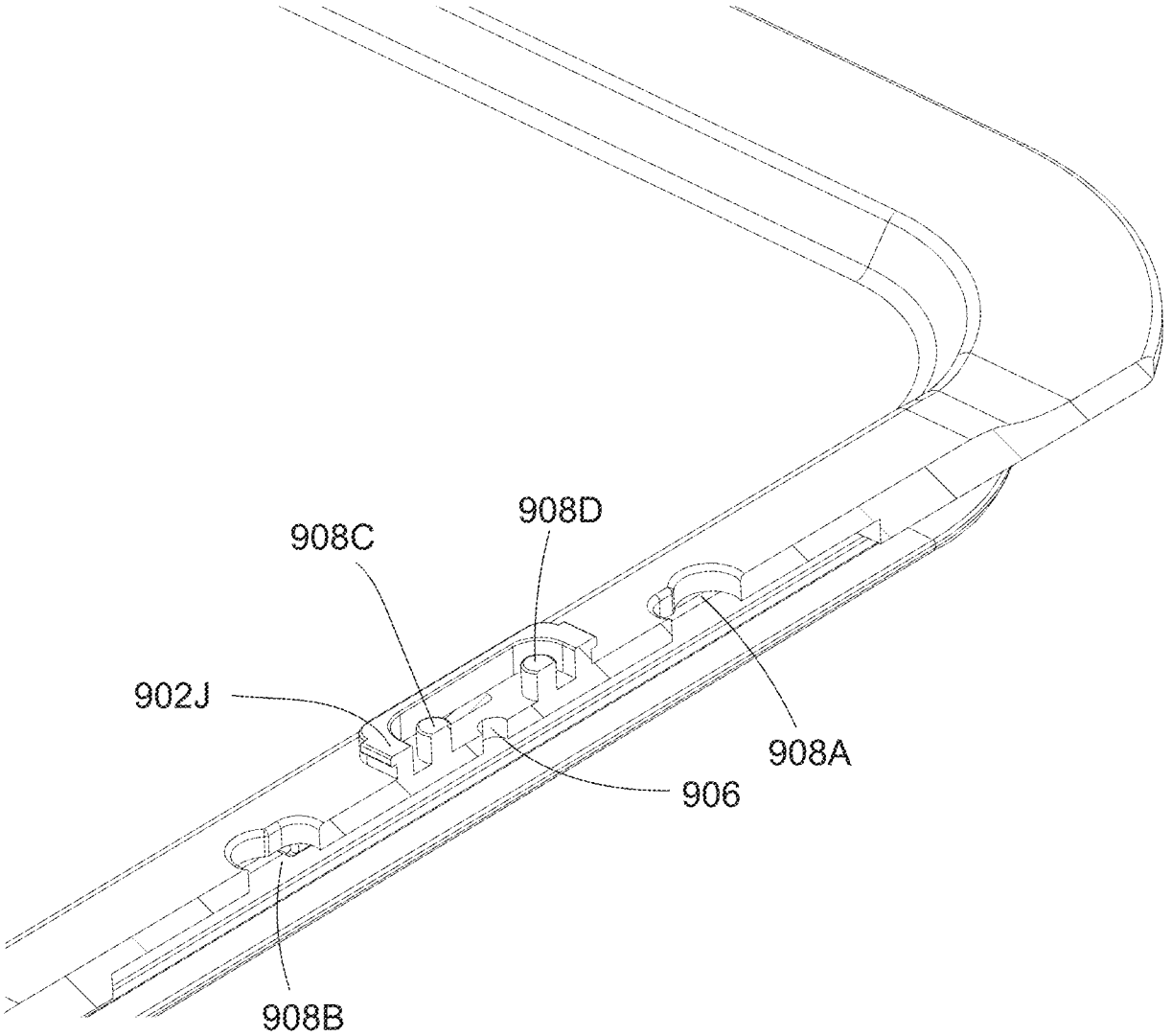
FIG. 28 shows a closer view on the fourth embodiment of a lid cover, in which the edge of the lid cover is cut.
Figure 29:
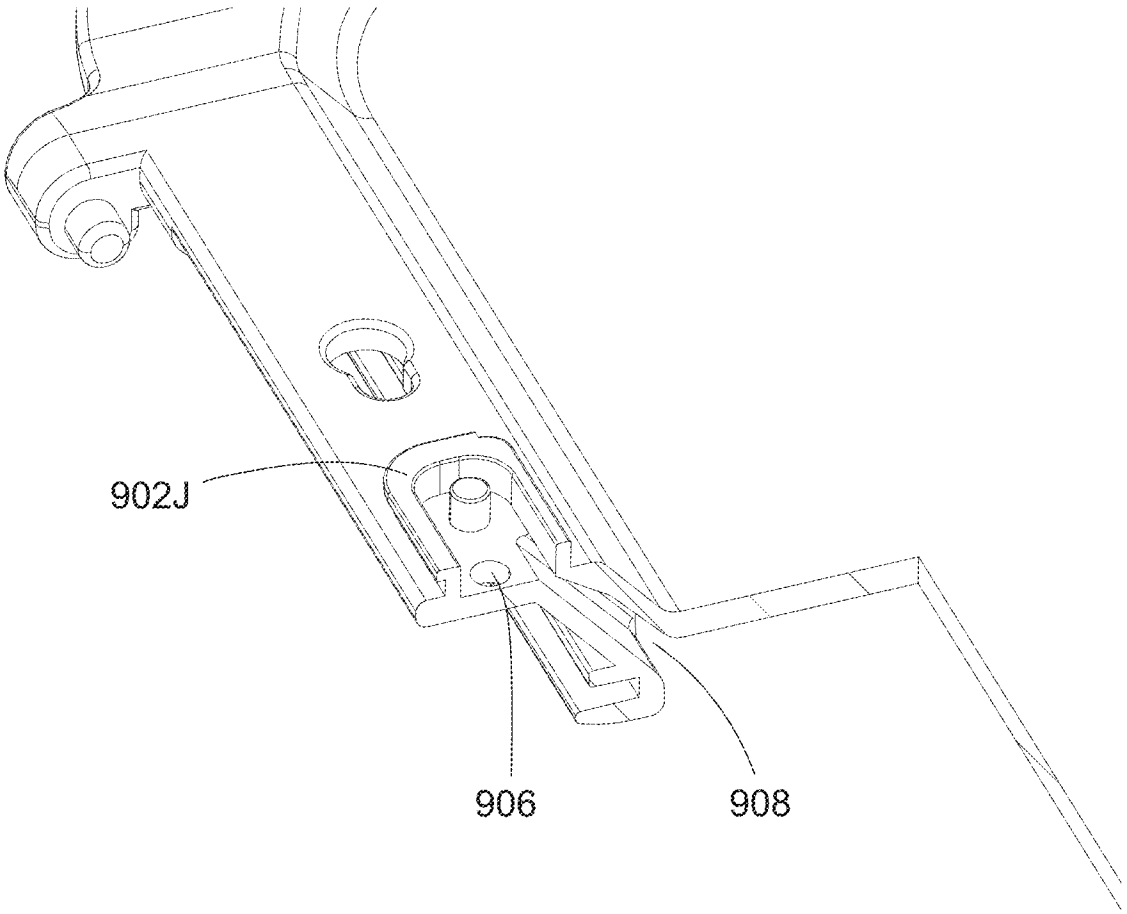
FIG. 29 shows a closer view on the fourth embodiment of the lid cover, in which the edge of the lid cover is cut.

FIG. 27 illustrates the seal 914A with different views. FIG. 27A is a perspective front view of the seal 914A, FIG. 27B is the perspective bottom view of the seal 914A, and FIG. 27C is the bottom view of the seal 914A. It can be seen that posts 914A-1 and 914A-2 are arrange at the sides of the seal 914A and are dimensioned fit to be accommodated by the pair of holes 908A and 908B respectively. The seal 914A is provided with a recessed region 914A-3 which is dimensioned fit to be accommodated by the flanged region 902J. It shall be envisaged that the recessed region and the flanged region are examples only. In some embodiments, the flanged region can be provided to the seal instead, i.e., replacing the recessed region. Likewise, the recessed region can be provided to the lid cover, i.e., replacing the flanged region. In the recessed region 914A-3, there are two apertures 914A-4 and 914A-5 at the sides thereof for assembling the seal 914A to the lid cover 902. FIGS. 28 and 29 show a closer view on the fourth embodiment of a lid cover, in which the edge of the lid cover is cut. It can be seen that the flanged region 902J is provided with two posts 908C and 908D therein. It shall be understood that the two posts 908C and 908D are dimensioned fit to be received by two apertures 914A-4 and 914A-5. The flanged region 902J, the posts 908C and 908D, the pair of holes 908A and 908B are used to accommodate the seal 914A, defining an access means allowing users to clean the first opening 906 and the gas channel member between the first opening 906 and the second opening 908 as defined in the gas channel in FIG. 16D. When the seal 914A is disassembled/removable from the lid cover 902, the first opening 906 is outwardly exposed. It shall be understood that the access means disclosed in the fourth embodiment is an example only. Those skilled in the art could make adaptive modification on this basis.

Figure 30:
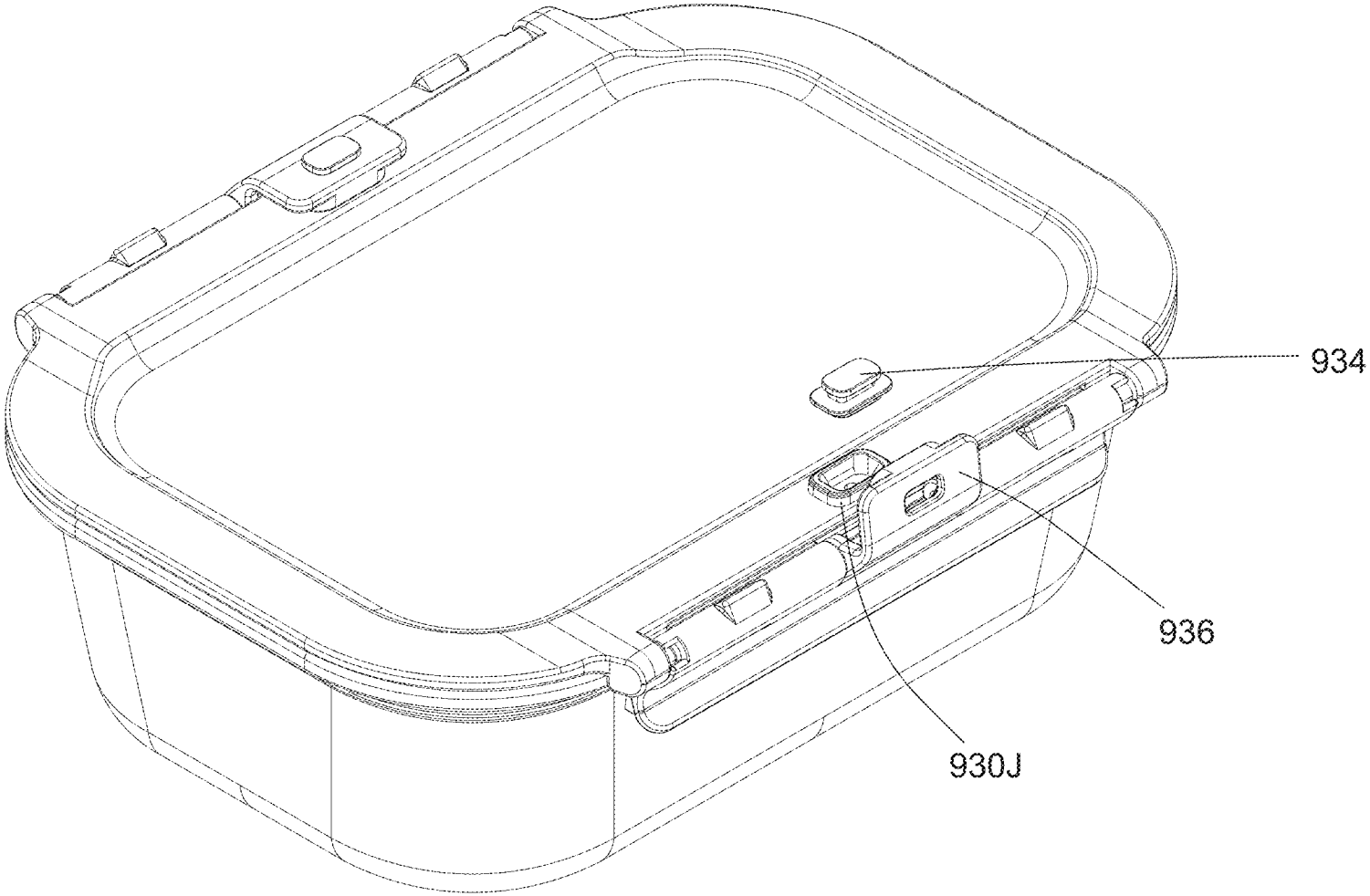
FIG. 30 shows a fifth embodiment of a closure means sealed to a container.
Figure 31:
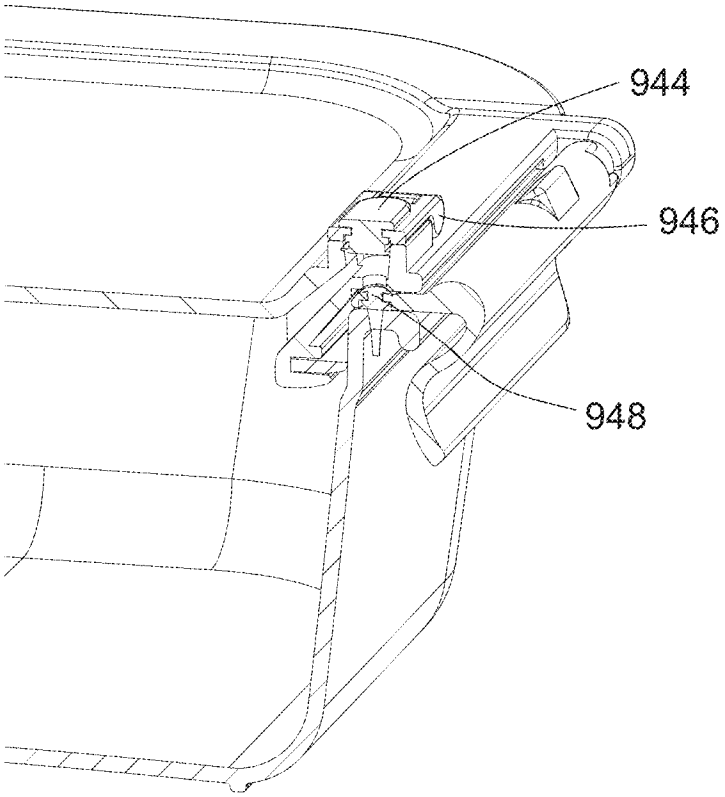
FIG. 31 shows a sixth embodiment of a closure means sealed to a container.

FIG. 30 illustrates a fifth embodiment of the closure means of the present invention. The fifth embodiment comprises a lid cover 930 and a flanged region 930J encompassing the first opening. FIG. 30 also shows a cap 934 which is sized and shaped to be received in the flanged region 930J. The wing member is provided with a cover 936 having an aperture that is dimensioned fit to receive the cap 934 by snug-fit. The cover 936 is pivotably or hingedly connected to the wing member such that the cover 936 can be positioned between a first position where the cover 936 engages with the flanged region 930J and a second position where the cover 936 does not engage with the flanged region 930J. In the second position of the cover 936, the cap 934 is removed and thus the first opening of the gas channel is outwardly exposed. It shall be understood that the cover 936 is not limited to be provided to the wing member. In some embodiments, the cover 936 can be provided to the lid cover 930 and the cap 934 is snuggly fitted into the aperture of the cover 936 such as the illustration in FIG. 31 which shows a sixth embodiment of the closure means of the present invention. The sixth embodiment shows that a cover 946 pivotably or hingedly connected to the lid cover.

With aforementioned described contents, in particular the described features of the closure means and the container, it shall be understood that air inside the container will be evacuated away during pressing the closure means of the present invention downwards, the air will be evacuated away through the disclosed gas channeling means. On the contrary, atmospheric gas will enter the container through the disclosed gas channeling means during lifting up the closure means of the present invention.

The above-described shall not be interpreted to be restricted by the examples or figures only. It is to be expressly understood, however, that such modifications and adaptations are within the scope of inventio in this aspect. For instance, features illustrated or described as part of one embodiment can be used on another embodiment to yield a still further embodiment. Thus, it is intended that the present disclosure cover such modifications and variations and their equivalents.

What is claimed is:

1. A closure means for closing the opening of a container, said closure means comprising:

a) a lid assembly, comprising:

a lid cover, configured to provide an upper plate and a lower plate connecting said upper plate via standing wall therebetween, said upper plate is provided with at least one hinge member;

at least one wing member comprising a handling portion, a flipping portion, and a stopper portion, said wing member pivotably connecting to said lid cover at said hinge member and thus movable between a first position where said stopper portion being away from said upper plate of said lid cover and a second position where said stopper portion being engaged with said upper plate of said lid cover and thus the upward movement of said wing member with respect to said lid cover being limited; and b) a scaling element, fittingly mounted around said standing wall of said lid cover, and characterized in that, in a first configuration where said container being closed with said closure means, said wing member being moved from said first position to said second position causing said lid cover being moved upwards automatically.

2. The closure means according to claim 1, characterized in that, in said second position, said stopper portion of said wing member engaging with said upper plate of said lid cover.

3. The closure means according to claim 1, characterized in that, in said second position, said stopper portion of said wing member engaging with said upper plate of said lid cover, wherein the angle between said flipping portion and said lid cover does not exceed 90 degrees.

4. The closure means according to claim 1, characterized in that, in a second configuration where said closure means being assembled to said container but yet unsealing said container, said wing member being moved from said second position to said first position causing said lid cover being moved downwards automatically.

5. The closure means according to claim 4, characterized in that, the transition from said second configuration to said first configuration can be operated by pushing said lid cover downwards.

6. The closure means according to claim 1, characterized in that, when said lid cover is provided with two wing members, in said first configuration where said container being closed with said closure means, said wing members being moved from said first position to said second position causing said lid cover being moved vertically upwards automatically.

7. The closure means according to claim 4, characterized in that, said sealing element is received in said container after said container is sealed with said closure means.

8. The closure means according to claim 4, said container having surrounding wall having a first edge connecting to a bottom and a second edge defining an open-top for said container, characterized in that, in said first configuration, the engagement between said flipping portion of said wing member and said second edge of said container being surface contact.

9. The closure means according to claim 8, characterized in that, in said second configuration, the engagement between said flipping portion of said wing member and said second edge of said container being line contact or point contact.

10. The closure means according to claim 1, characterized in that, said handling portion is provided with at least one locking member; and said container having surrounding wall having a first edge connecting to a bottom and a second edge defining an open-top for said container, wherein said second edge is configured to engage with said locking member.

11. The closure means according to claim 10, characterized in that, said locking member is selected from an inwardly protruded finger and/or an elevation for interacting with said second edge of said container.

12. The closure means according to claim 1, characterized in that, said lid cover is provided with a tooth member, such that the interaction between said tooth member and said flipping portion of said wing member provides a locking effect.

13. The closure means according to claim 12, characterized in that, in said first configuration, said tooth member at least being covered by said flipping portion; and in said second configuration, the interaction between said tooth member and said flipping portion being free.

* * * * *